US012144445B2

(12) United States Patent
Lucas et al.

(10) Patent No.: US 12,144,445 B2
(45) Date of Patent: Nov. 19, 2024

(54) MODULAR CUP HOLDER TRAY ASSEMBLY

(71) Applicant: J J L Innovations LLC, Waxhaw, NC (US)

(72) Inventors: John Lucas, Waxhaw, NC (US); Paul Lucas, Waxhaw, NC (US)

(73) Assignee: J J L Innovations LLC, Waxhaw, NC (US)

( * ) Notice: Subject to any disclaimer, the term of this patent is extended or adjusted under 35 U.S.C. 154(b) by 0 days.

(21) Appl. No.: 18/045,697

(22) Filed: Oct. 11, 2022

(65) Prior Publication Data

US 2024/0115064 A1 Apr. 11, 2024

(51) Int. Cl.

| | |
|---|---|
| ***A47G 23/02*** | (2006.01) |
| ***A47G 23/06*** | (2006.01) |
| ***B65D 1/36*** | (2006.01) |

(52) U.S. Cl.

CPC ..... *A47G 23/0208* (2013.01); *A47G 23/0616* (2013.01); *B65D 1/36* (2013.01)

(58) Field of Classification Search

CPC .. A47G 23/0616; B65D 1/36; B65D 21/0201; B65D 21/02; B65D 21/0206; B65D 21/083; B65D 21/08; B65D 25/2835; B65D 25/2838; B65D 25/32

USPC ..... 206/144, 139, 140, 141, 142, 143, 162, 206/163, 167, 192, 199, 203, 427, 428, 206/564, 561; 220/23.4, 23.2, 4.26, 4.27

See application file for complete search history.

(56) References Cited

U.S. PATENT DOCUMENTS

| | | | | |
|---|---|---|---|---|
| 2,636,633 A * | 4/1953 | Carlson | B26B 29/00 | 131/238 |
| 3,111,153 A * | 11/1963 | Sonka | B65D 71/0011 | 220/772 |
| 3,131,829 A * | 5/1964 | Masser | B65D 21/0204 | 217/65 |
| 3,317,081 A * | 5/1967 | Cornelius | B65D 71/0003 | 206/203 |
| 3,635,350 A * | 1/1972 | Wolf | A47B 87/0276 | 211/40 |

(Continued)

FOREIGN PATENT DOCUMENTS

| | | |
|---|---|---|
| EP | 2433878 B1 | 11/2013 |
| WO | 2007/070668 A2 | 6/2007 |

OTHER PUBLICATIONS

"4 Cup Drink Carrier, Biodegradable—Pulp Fiber 4 Cup Carrier—300/Case," WebstaurantStore, 2022.

*Primary Examiner* — Robert Poon
(74) *Attorney, Agent, or Firm* — POLSINELLI PC

(57) ABSTRACT

Disclosed herein is a modular cup holder tray assembly, which can include a tray and at least one handle operably coupled to the tray. The tray can include a base and sidewalls. The base can define a top surface and have more than one cup holder extending therethrough. The sidewalls can be substantially perpendicular to the base. At least two-tray coupling apertures can extend through a first sidewall. At least two-tray coupling protrusions can extend outward from a second sidewall, opposite the first sidewall. The at least two-tray coupling protrusions can be configured to engage the at least two-tray coupling apertures of a second tray. The at least one handle can have a first end removably coupled to a third sidewall and a second end removably coupled to a fourth sidewall, opposite the third sidewall.

20 Claims, 22 Drawing Sheets

(56) References Cited

U.S. PATENT DOCUMENTS

| | | | | |
|---|---|---|---|---|
| 4,328,902 | A * | 5/1982 | North | B65D 21/0204 220/516 |
| 5,507,543 | A * | 4/1996 | Shefflin | B65D 71/0003 206/427 |
| 5,833,056 | A * | 11/1998 | Goldman | B65D 33/00 206/199 |
| 6,321,929 | B1 * | 11/2001 | Weshler | B65D 25/2835 206/217 |
| 7,097,034 | B2 | 8/2006 | Woog | |
| 7,267,224 | B2 | 9/2007 | Cuomo | |
| 8,091,702 | B1 | 1/2012 | Keip | |
| 8,281,950 | B2 | 10/2012 | Potts et al. | |
| 8,479,626 | B1 * | 7/2013 | Winkler | B26D 7/00 83/613 |
| 9,718,592 | B1 | 8/2017 | Scanlan et al. | |
| 2005/0109642 | A1 | 5/2005 | Huff et al. | |
| 2005/0279744 | A1 * | 12/2005 | Conrad | B65D 21/0204 220/23.4 |
| 2008/0000783 | A1 * | 1/2008 | Faulkner | B65D 21/0204 206/139 |
| 2012/0234831 | A1 * | 9/2012 | Lin | H05K 7/1487 220/23.4 |
| 2013/0068635 | A1 * | 3/2013 | Ralph | B65D 25/22 206/139 |
| 2014/0353181 | A1 * | 12/2014 | Chitsazan | A47G 23/0208 206/162 |
| 2016/0318647 | A1 * | 11/2016 | De Lucia | B29C 66/304 |
| 2017/0172330 | A1 * | 6/2017 | Cameron | B65D 25/24 |
| 2018/0079546 | A1 * | 3/2018 | Hsieh | B65D 43/161 |
| 2022/0119152 | A1 * | 4/2022 | Blankinship | B65D 25/32 |

* cited by examiner

MODULAR CUP HOLDER TRAY ASSEMBLY

FIELD

The present disclosure relates to cup holders. More specifically, the present disclosure is directed to a modular cup holder tray assembly and methods of use thereof.

BACKGROUND

Cup holders are used carry, or otherwise transport, drinks. Traditionally, fast food restaurants and coffeehouses have provided a portable cup holder to drive-thru customers that ordered multiple drinks. The drinks are secured in the cup holder so that the customer can receive and transport the drinks. Recent increase in take-out services and food delivery services (e.g., Uber Eats) has significantly increased the number of drinks being transported. Accordingly, restaurant customers and delivery couriers are increasingly using traditional cup holders to transport drinks. However, traditional cup holders can be inconvenient and limiting.

Therefore, there is a need for a cup holder that is adaptable to provide convenience for the user carrying the cups. It is with these thoughts in mind, among others, that the modular cup holder tray assembly was developed.

SUMMARY

Aspects of the present disclosure include a modular cup holder tray. The modular cup holder tray can include a tray that has a base, which can define a top surface, and sidewalls coupled to the base. The sidewalls can be substantially perpendicular to the base and can include a first sidewall, a second sidewall opposite the first sidewall, a third sidewall, and a fourth sidewall opposite the third sidewall. Multiple cup holders can extend through the base of the tray. The cup holders can each defining a circular opening in the top surface of the tray. At least two tray-coupling apertures can extend through the first sidewall of the tray. At least two tray-coupling protrusions can extend outward from the second sidewall of the tray. The tray-coupling protrusions can be configured to engage the tray-coupling apertures of a second tray to removably couple the tray to the second tray. The tray-coupling apertures of the second tray can correspond in shape and size to the at least two tray-coupling apertures of the tray. At least one handle can be operably coupled to the tray. Each handle can include a first end removably coupled to the third sidewall and a second end removably coupled to the fourth sidewall.

In certain instances, the tray-coupling apertures of the tray can include a receiving borehole and a retaining borehole in communication with the receiving borehole. The receiving borehole can have a substantially circular cross-section that defines a diameter and a center point. The retaining borehole can have a substantially circular cross-section that defines a diameter and a center point. The diameter of the retaining borehole can be smaller than the diameter of the receiving borehole. A line segment connecting the center point of the retaining borehole to the center point of the receiving borehole can be horizontal when the top surface of the tray is parallel with a horizontal plane.

In certain instances, the at least tray-coupling protrusions of the tray can include a post and a head. The post can be coupled to the second sidewall and extend outwards. The head can be coupled to the post. The post can include a rib that extends radially outward. The rib can be coupled to the head and to the second sidewall of the tray. The post can have a substantially circular cross-section that defines a diameter. The head can have a substantially circular cross-section that defines a diameter. The diameter of the head can be greater than the diameter of the post.

In certain instances, the modular cup holder tray can include at least two handle-mounting apertures that extend through the third sidewall of the tray and at least two handle-mounting apertures that extend through the fourth sidewall of the tray. The handles can each have a handle-mounting protrusion extending from the first end and the second end. Each of the handle-mounting protrusions can be configured to engage and removably couple with the handle-mounting apertures of the tray.

In certain instances, the handle-mounting apertures can each include a borehole and a keyway in communication with the borehole. The borehole can have a substantially circular cross-section. The keyway can be oriented downward and inward from the borehole when the top surface of the tray is parallel with a horizontal plane. A midline of the keyway can form approximately a 45-degree angle with respect to the top surface of the tray and approximately a 45-degree angle with respect to a vertical plane located between and parallel to the first sidewall and the second sidewall.

In certain instances, the handle-mounting protrusions can each include a post and a key. The post can be coupled to the handle and extend outwards. The key can be coupled to the post and extend radially outwards. The post can have a circular cross-section and define a diameter. The handle-mounting apertures can each have a circular cross-section and define a diameter. The diameter of the post can be smaller than the diameter of the handle-mounting aperture. The key can be configured to contact an inner surface of the third sidewall or an inner surface of the fourth sidewall when the handle-mounting protrusion is inserted through the handle-mounting aperture and rotated to couple the handle to the tray.

In certain instances, the handle-mounting protrusions can each include a spacer between the handle and the post. The spacer can have a substantially circular cross-section that defines a diameter. The diameter of the spacer can be greater than the diameter of the post.

In certain instances, the cup holders can each include a bottom wall and a sidewall. The bottom wall can include a circular edge. The sidewall can connect the circular edge of the bottom wall to the circular opening in the top surface of the tray. The sidewalls can be angled with respect to a vertical axis. The cup holders can be frusto-conical in shape.

In certain instances, the second sidewall of the tray can be planar and a first sidewall of the second tray can be planar. The second sidewall of the tray and the first sidewall of the second tray can abut each other when the tray is removably coupled to a second tray.

In certain instances, the second sidewall of the tray and the first sidewall of the second tray can abut each other such that the second sidewall and the first sidewall inhibit rotation of the tray with respect to the second tray.

In certain instances, the second sidewall of the tray and the first sidewall of the second tray can abut each other such that the second sidewall and the first sidewall are substantially co-planar when the tray is removably coupled to a second tray.

In certain instances, the top surface of the tray can be planar and a top surface of the second tray can be planar. The second sidewall of the tray and the first sidewall of the second tray can abut each other such that top surface of the tray and the top surface of the second tray are substantially co-planar when the tray is removably coupled to a second tray.

Aspects of the present disclosure include a modular cup holder tray assembly that includes a first modular cup holder tray and a second modular cup holder tray. The first modular cup holder tray can include a first tray and a first group of cupholders. The first tray can include a first base and a first sidewall. The first base can define a first top surface and the first group of cupholders can extend through the first top surface. The first sidewall can include a first pair of apertures and a first pair of protrusions opposite the first pair of apertures. The second modular cup holder tray can include a second tray and a second group of cupholders. The second tray can include a second base and a second sidewall. The second base can define a second top surface and the second group of cupholders extending through the second top surface. The second sidewall can include a second pair of apertures and a second pair of protrusions opposite the second pair of apertures. The modular cup holder tray assembly can include a first handle that can removably couple to the first tray and a second handle that can removably coupled to the second tray. The first tray can be removably coupled to the second tray by the first pair of protrusions received in the second pair of apertures. The first handle and the second handle can be operable to transport the tray and the second tray.

In certain instances, the first sidewall can define a first outer surface that is planar. The first pair of protrusions can extend from the first outer surface. The second sidewall can define a second outer surface that is planar. The second pair of apertures can extend through the second outer surface. The first outer surface and the second outer surface can abut each other when the first tray is removably coupled to the second tray.

In certain instances, the first outer surface abutting the second outer surface can inhibit rotation between the first tray and the second tray when the first tray and the second tray are removably coupled together and the first tray and the second tray are transported by the first handle and the second handle.

In certain instances, the first top surface and the second top surface can be planar. The first top surface and the second top surface can be substantially co-planar when the first tray is removably coupled to the second tray. The first top surface and the second top surface can remain substantially co-planar when the first tray and the second tray are transported by the first handle and the second handle.

In certain instances, the first outer surface and the second outer surface can be substantially co-planar when the first tray is removably coupled to the second tray. The first outer surface and the second outer surface can remain substantially co-planar when the first tray and the second tray are transported by the first handle and the second handle.

In certain instances, the modular cup holder tray assembly can include a first handle removably coupled to the first tray and a second handle removably coupled to the second tray.

In certain instances, the top surface of the first tray and the top surface of the second tray can each contain markings to indicate a lock direction to slidably engage the first tray and second tray. The top surface of the first tray and the top surface of the second tray can each contain markings to indicate an unlock direction to slidably disengage the first tray and second tray.

In certain instances, the first modular cup holder tray and the second modular cupholder tray can be configured to be carried by a pair of outer handles, a pair of inner handles, or both when the first tray is removably coupled to the second tray.

BRIEF DESCRIPTION OF THE DRAWINGS

The description will be more fully understood with reference to the following figures and data graphs, which are presented as various embodiments of the disclosure and should not be construed as a complete recitation of the scope of the disclosure. It is noted that, for purposes of illustrative clarity, certain elements in various drawings may not be drawn to scale. Understanding that these drawings depict only exemplary embodiments of the disclosure and are not therefore to be considered to be limiting of its scope, the principles herein are described and explained with additional specificity and detail through the use of the accompanying drawings in which:

FIG. 1A illustrates an unassembled configuration. FIG. 1B illustrates an assembled configuration. FIG. 1C illustrates another assembled configuration with the trays holding cups.

FIGS. 3A-3B are a top view and perspective-top view, respectively, illustrating the alignment of tray-coupling protrusions of the first tray with tray-coupling apertures of the second tray. FIGS. 3C-3D are a top view and bottom view, respectively, illustrating the advancement of the tray-coupling protrusions into the tray-coupling apertures. FIGS. 3E-3F are a top view and bottom view, respectively, illustrating the slidable engagement of the tray-coupling protrusions with the tray-coupling apertures. FIG. 3G is a side view illustrating a first tray removably coupled to a second tray.

FIG. 4A is a perspective view of the handle. FIGS. 4B-4D illustrates a perspective-inside view, a perspective, outside view, and a side view, respectively, of a handle-mounting protrusion.

FIGS. 5A-5B are a top view and perspective-top view, respectively, illustrating the alignment of a handle-mounting protrusion of the handle with a handle-mounting aperture of a tray. FIGS. 5C-5D are a top view and bottom view, respectively, illustrating the advancement of the handle-mounting protrusion into the handle-mounting aperture.

FIGS. 5E-5F are a top view and bottom view, respectively, illustrating the rotatable engagement of the handle-mounting protrusion with the handle-mounting aperture.

DETAILED DESCRIPTION

Figure 1A:
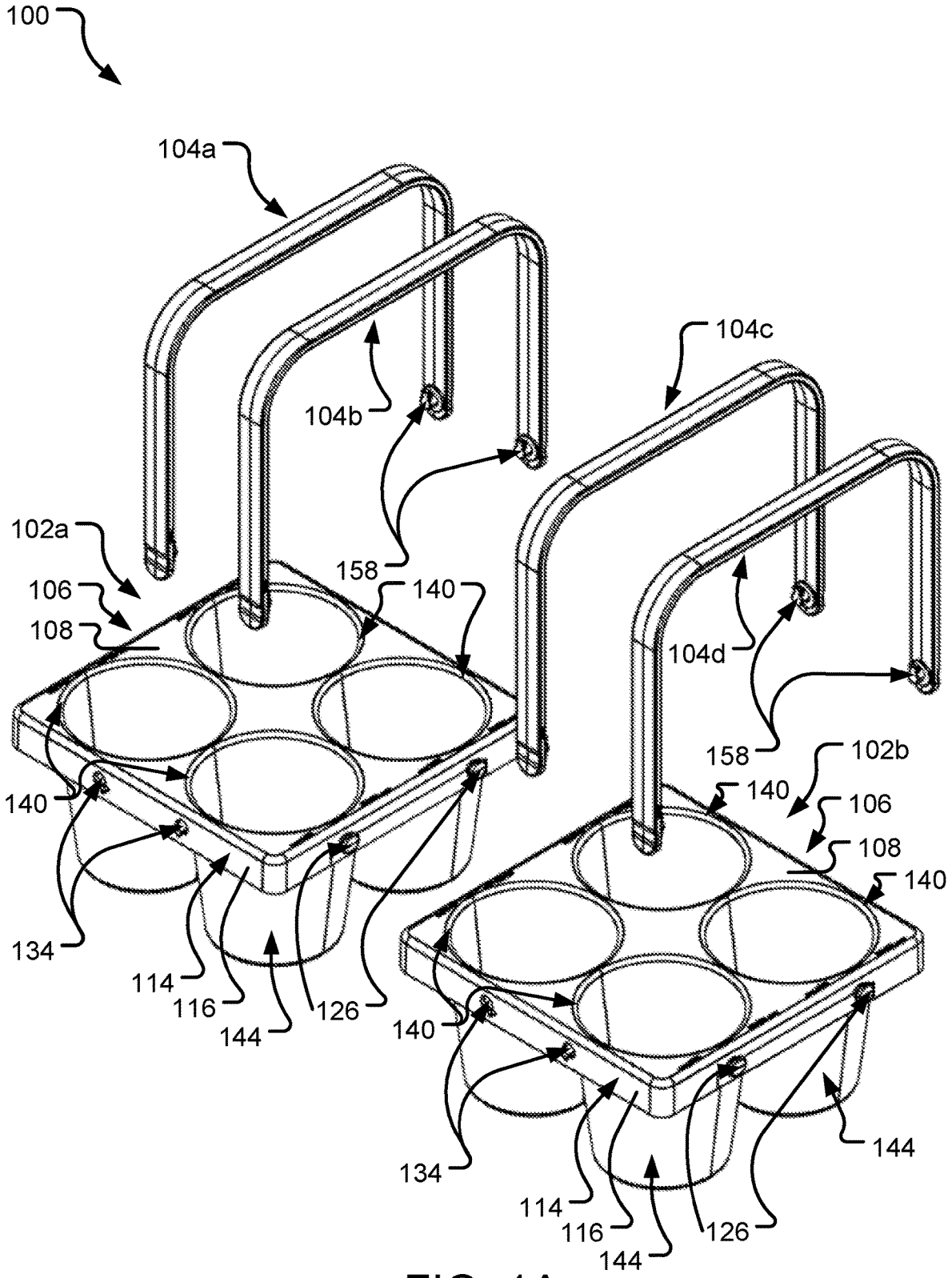
FIGS. 1A-1C illustrate perspective views of one instance of a modular cup holder tray assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout the above disclosure will now be presented.

The term "coupled" as used herein is defined as connected, whether directly or indirectly through intervening components, and is not necessarily limited to physical connections. The connection can be such that the objects are permanently connected or releasably connected.

The term "substantially" is defined to be essentially conforming to the particular dimension, shape or other word that substantially modifies, such that the component need not be exact.

The terms "comprising," "including" and "having" are used interchangeably in this disclosure. The terms "comprising," "including" and "having" mean to include, but not necessarily be limited to the things so described.

The present disclosure relates to a modular cup holder assembly, which can be used to carry, or otherwise transport, drinks. The modular cup holder assembly can include one or more trays. In certain instances, two or more trays can be removably coupled together. Additionally, the modular cup holder assembly can include one or more handles that can be removably coupled to one or more trays. Trays and/or handles that are removably coupled together can be decoupled, so that each tray and each handle can be reused in future configurations.

The modular cup holder assembly can be modified (e.g., various configurations of the one or more trays and one or more handles) according to the specific needs of a user (e.g., to transport a desired number of drinks). In one configuration, for example, two handles can be removably coupled to one tray and the assembly can be used to transport drinks. In another configuration, for example, two trays can be removably coupled together, two handles can be removably coupled to the trays (e.g., one handle connected to each tray), and the assembly can be used to transport drinks.

The modular cup holder assembly may be more convenient than traditional cup holders because it can be modified in accordance with the preference of the user.

Figure 1B:
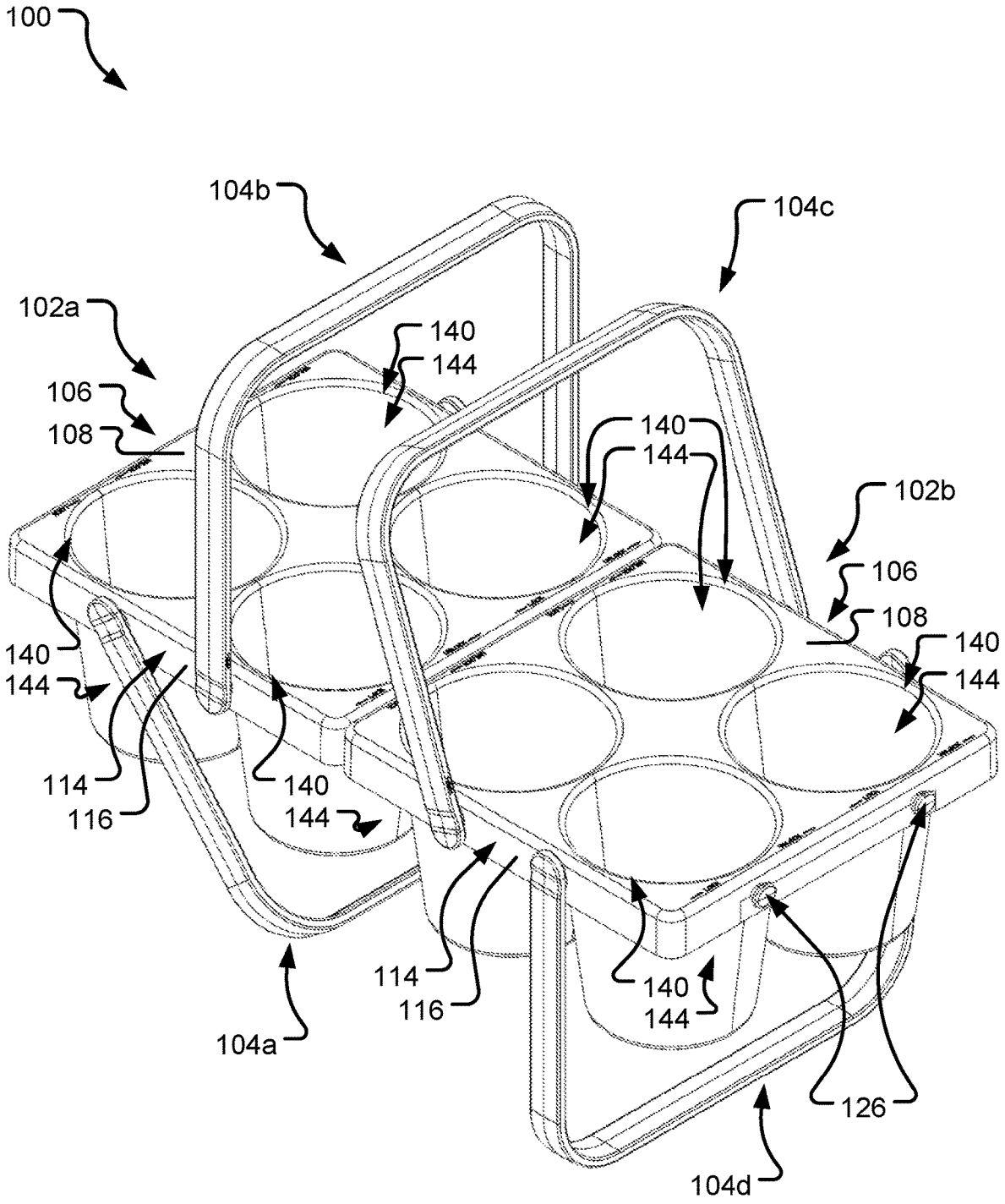
Figure 1C:
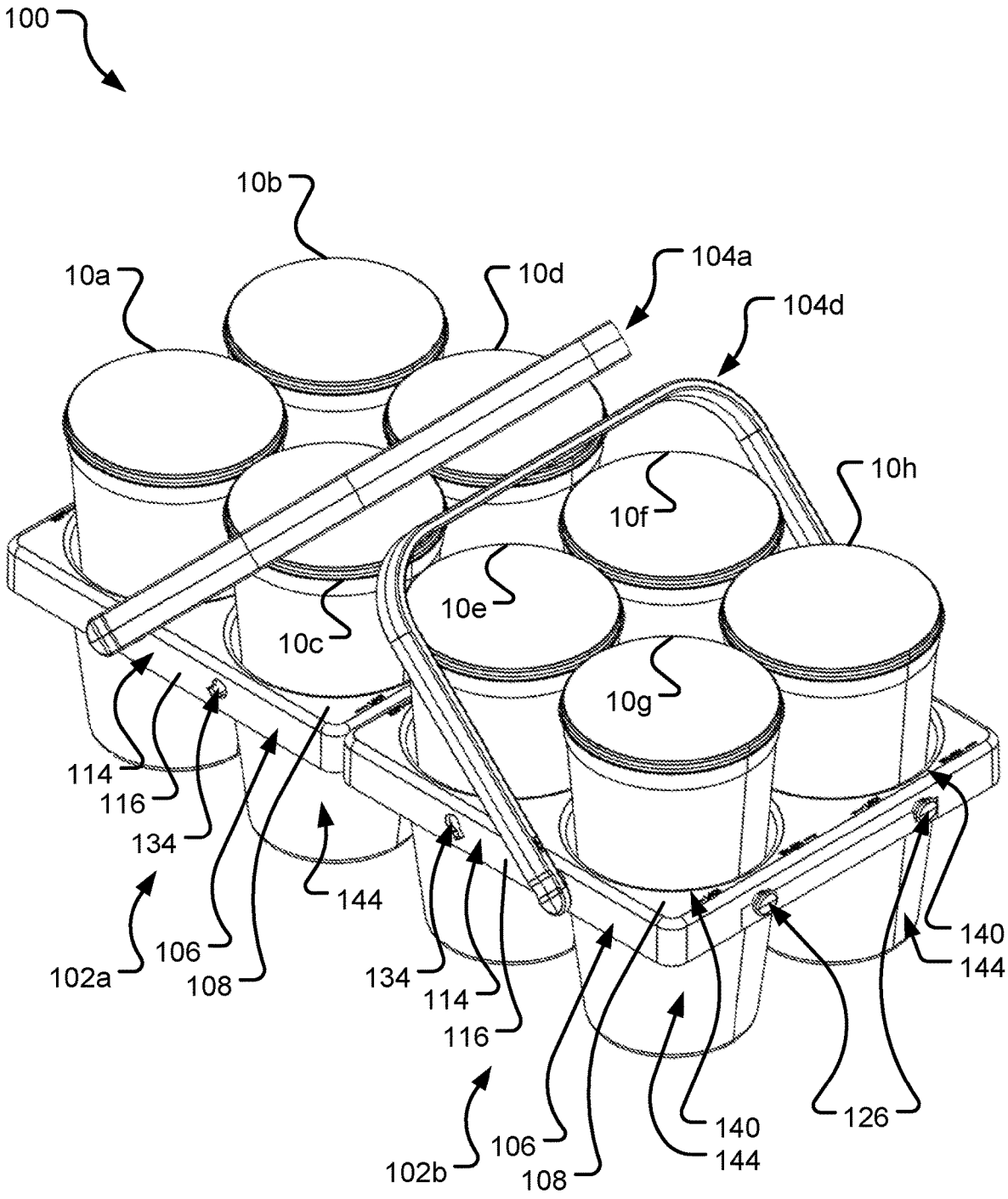

FIGS. 1A-1C illustrate one instance of a modular cup holder assembly 100. The cup holder assembly 100 can include one or more trays 102 (e.g., 102*a*, 102*b*) and one or more handles 104 (e.g., 104*a*, 104*b*, 104*c*, 104*d*). Although FIG. 1A illustrates the trays 102 and handles 104 in an unassembled configuration, the cup holder assembly 100 can be assembled in various configurations.

Two or more trays 102 can be removably coupled together (e.g., attached). For example, a first tray 102*a* can be removably coupled to a second tray 102*b*, as illustrated in FIG. 1B, which illustrates one instance of a modular cup holder assembly 100 in an assembled configuration. After the two or more trays 102 are removably coupled together, the trays 102 can be decoupled (e.g., detached). For example, a first tray 102*a* can be decoupled from a second tray 102*b*, as illustrated in FIG. 1A.

One or more handles 104 can be removably coupled (e.g., attached) to a tray 102. For example, a first handle 104*a* and a second handle 104*b* can be removably coupled to a first tray 102*a*, as illustrated in FIG. 1B. Additionally, a first handle 104*c* and a second handle 104*d* can be removably coupled to a second tray 102*b*. After the one or more handles 104 are removably coupled to a tray 102, the handles 104 can be decoupled (e.g., detached) from the tray 102. For example, the first handle 104*a* and second handle 104*b* can be decoupled from a first tray 102*a*, as illustrated in FIG. 1A. Additionally, the first handle 104*c* and second handle 104*d* can be decoupled from a second tray 102*b*.

Each handle 104 can rotate about the longitudinal axis of its handle-mounting protrusion 158 (which is described below) when the handle 104 is removably coupled to a tray 102 (e.g., the post 160 of the handle 104 can rotate within the borehole 136 of the handle-mounting aperture 134 of the tray 102). For example, FIG. 1B illustrates handles 104*a*, 104*b*, 104*c*, 104*d* in various orientations (e.g., rotation about the longitudinal axis of each handle-mounting protrusion 158).

Continuing with FIGS. 1A-1C, the one or more trays 102 and/or one or more handles 104 of the cup holder assembly 100 can be assembled in various configurations (e.g., modular), in accordance with the preference of the user. In some instances, one or more handles 104 can be coupled to the one or more trays 102. For example, a first handle 104*a* and/or a second handle 104*b* can be removably coupled to a first tray 102*a*. Separately or additionally, a first handle 104*c* and/or a second handle 104*d* can be removably coupled to a second tray 102*b*. Separately or additionally, the first tray 102*a* and the second tray 102*b* can be removably coupled together.

For example, a first tray 102*a* can be removably coupled to a second tray 102*b*, as illustrated, for example, in FIG. 1B. In some instances, handles 104*a*, 104*d* (e.g., the "outer" handles of the cup holder assembly 100) can be removably coupled to the first tray 102*a* and second tray 102*b*, respectively. In other words, the outer handles 104*a*, 104*d* are located on the outer sides of the second median plane (which is discussed below) of each tray 102*a*, 102*b* with respect to the abutting surfaces of each tray 102*a*, 102*b*. In some instances, handles 104*b*, 104*c* (e.g., the "inner" handles of the cup holder assembly 100) can be removably coupled to the first tray 102*a* and second tray 102*b*, respectively. In other words, the inner handles 104*b*, 104*c* are located on the inner side of the second median plane (which is discussed below) of each tray 102*a*, 102*b* with respect to the abutting surfaces of each tray 102*a*, 102*b*. In some instances, the outer handles 104*a*, 104*d* and inner handles 104*b*, 104*c* can be removably coupled to the first tray 102*a* and second tray 102*b*, as illustrated, for example, in FIG. 1B. The outer handles 104*a*, 104*d* can be configured so that the elongated body 148 (which is discussed below) of each handle 104*a*, 104*d* can be joined a directly above the abutting surfaces of each tray 102*a*, 102*b* (e.g., in a vertical plane when the trays 102*a*, 102*b* are facing upwards). Similarly, the inner handles 104*b*, 104*c* can be configured so that the elongated body 148 of each handle 104*b*, 104*c* can be joined in a directly above the abutting surfaces of each tray 102*a*, 102*b*.

The modular cup holder assembly 100 can receive and support (e.g., hold) one or more cups 10 (e.g., 10*a*, 10*b*, 10*c*, 10*d*, 10*e*, 10*f*, 10*g*, 10*h*), as illustrated, for example, in FIG. 1C. The cup holder assembly 100 can be used to transport the cups 10. In addition to illustrating cups 10, FIG. 10C illustrates another instance of a cup holder assembly 100. For example, a first tray 102*a* can be removably coupled to a second tray 102*b*, a first handle 104*a* can be removably coupled to the first tray 102*a*, and a second handle 104*d* can be removably coupled to the second tray 102*b* (e.g., the outer handles 104*a*, 104*d* are removably coupled to the first tray 102*a* and second tray 102*b*, respectively).

It should be appreciated that specific examples of configurations for the modular cup holder assembly 100 that are presented herein (e.g., described in the specification, illustrated in the drawings) are non-limiting examples. The cup holder assembly 100 is modular and can be arranged in various configurations. As one example (not shown in the figures), the cup holder assembly 100 can include more than two trays 102 (e.g., three trays, four trays, five trays, or six or more trays) removably coupled together. One or more handles can be removably coupled to the more than two trays 102. As another example (not shown in the figures), the cup holder assembly 100 can include two or more trays 102 removably coupled together without any handles 104 coupled thereto.

FIGS. 2A-2G illustrate one instance of a tray 102, which can be used in a modular cup holder assembly 100. In some instances, however, the tray 102 can be used in an unassembled configuration (e.g., not removably coupled to a second tray and no handles removably coupled thereto). The tray 102 can be made out of polymer. For example, the tray 102 can be made out of thermoplastic. Specifically, as non-limiting examples, the tray 102 can be made out of acrylonitrile butadiene styrene (ABS), acrylic, engineered thermoplastics, decorative film laminates, polyethylene (PE), polypropylene (PP), polystyrene (PS), and/or polyvinyl chloride (PVC). The tray 102 can include one or more markings (e.g., embossed onto or debossed into any surface of the tray 102) indicating the material of the tray 102. In one instance, the tray 102 can include a "PP" marking to indicate that it is made out of polypropylene. For example, the "PP" marking can be located on the bottom surface 110 of the tray 102, as illustrated in the bottom view in FIG. 2C.

Figure 2A:
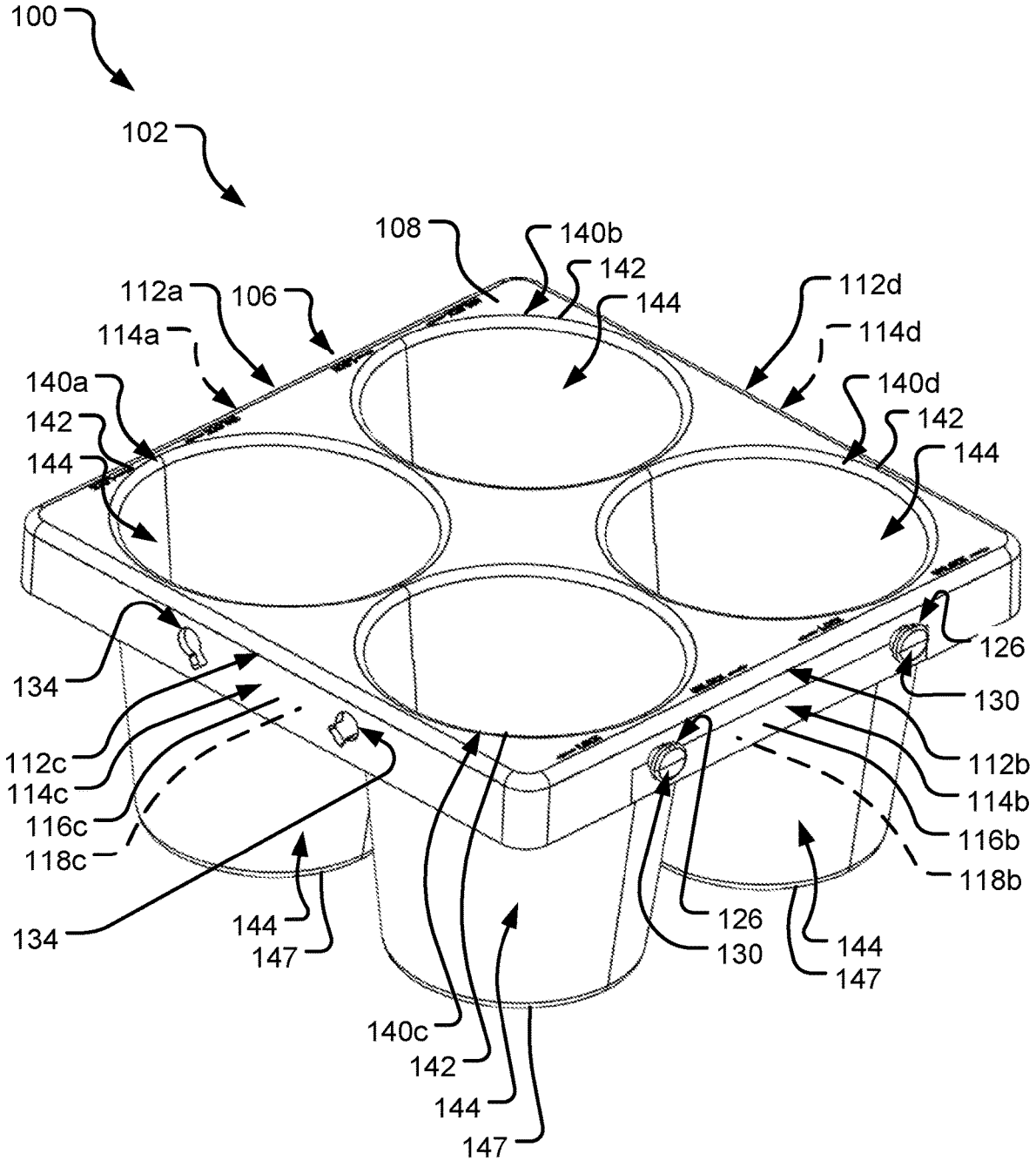
FIGS. 2A-2G illustrate one instance of a tray in a perspective view, top view, bottom view, left-side view, right-side view, front-side view, and back-side view, respectively.

The tray 102 can include a base 106, as illustrated, for example, in the perspective view in FIG. 2A. The base 106 can define a top surface 108, as illustrated in in FIG. 2B, which is a top view of the tray 102. In some instances, the top surface 108 can be substantially planar (e.g., flat). Similarly, the base 106 can define a bottom surface 110, as illustrated in FIG. 2C, which is a bottom view of the tray 102. In some instances, the bottom surface 110 can be substantially planar. The distance between the top surface 108 and the bottom surface 110 can define a thickness of the base 106 of the tray 102. In some instances, the thickness of the base 106 can be relatively uniform (e.g., the top surface 108 and bottom surface 110 are both substantially planar and are parallel to each other). However, in other instances, the thickness of the base 106 can vary (e.g., non-uniform).

The bottom surface 110 can include one or more reinforcing structures 111, as illustrated, for example, in the bottom view in FIG. 2C. The reinforcing structures 111 can reinforce the tray 102 (e.g., add rigidity). Each reinforcing structure 111 can couple the bottom surface 110 of the tray 102 to the sidewall 114 of the tray 102, the bottom surface 110 of the tray 102 to the sidewall 144 of the cup holder 140 (which is discussed below), and/or the sidewall 144 of one cup holder 140 to the sidewall 144 of another cup holder 140.

The base 106 can define ends 112 (e.g., 112*a*, 112*b*, 112*c*, 112*d*) of the base 106, as illustrated, for example, in FIG. 2A. The base 106 can define a first end 112*a*, a second end 112*b* opposite the first end 112*a*, a third end 112*c*, and a fourth end 112*d* opposite the third end 112*c*. In some instances, the top surface 108 of the base 106 can be substantially square, as illustrated, for example, in the top view in FIG. 2B. In other instances, the top surface 108 of the base 106 can be substantially rectangular.

The base 106 of the tray 102 can define a length, which can be defined by the distance measured between the first end 112*a* and the second end 112*b*. Similarly, the base 106 of the tray 102 can define a width, which can be defined by the distance measured between the third end 112*c* and the fourth end 112*d*. In some examples, the length and/or width of the tray 102 can be within a range from approximately 7-inches to approximately 12-inches. In some examples, the length and/or width can be within a range from approximately 8.5-inches to approximately 10.5-inches. In one example, the length and/or width can be approximately 9-inches. In one example, the length and/or width can be approximately 10-inches.

Figure 2B:
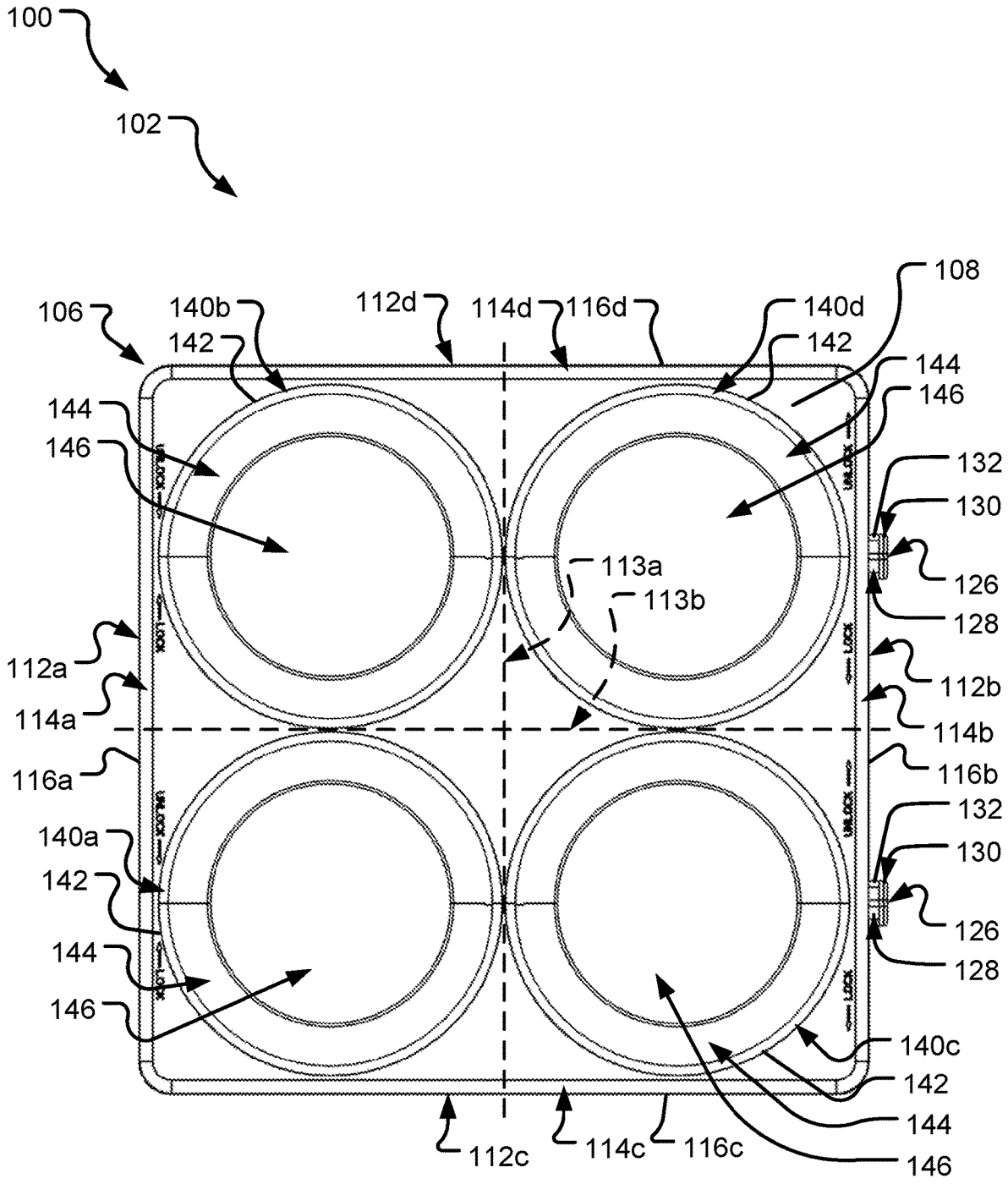
Figure 2C:
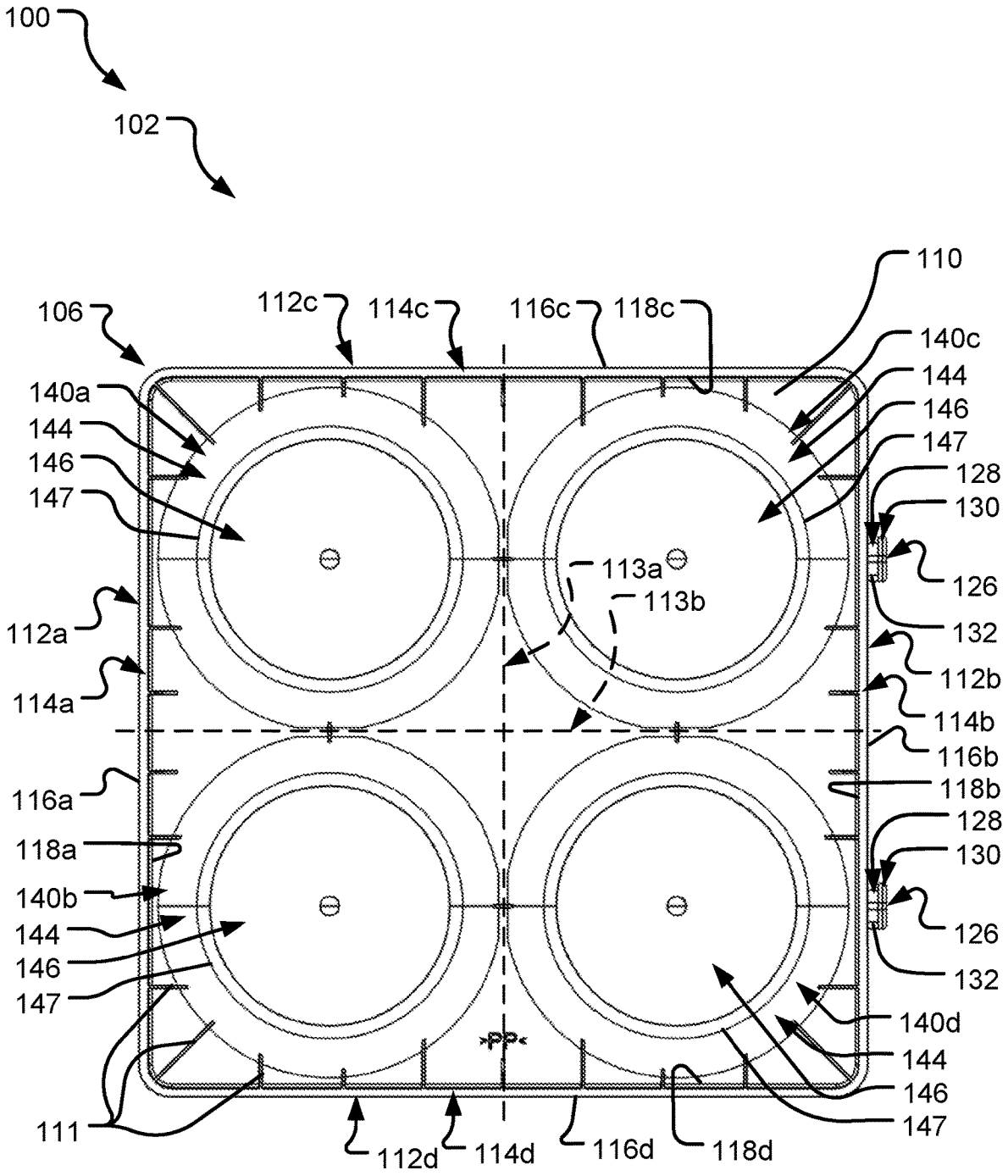

A first median plane, which can extend vertically through the dashed line 113*a* illustrated on the top view of FIG. 2B and the bottom view of FIG. 2C, can define a left-half of the tray 102 and a right-half of the tray 102. In other words, the first median plane can vertically extend through the mid-length (e.g., between the first end 112*a* and the second end 112*b*) of the tray 102. Similarly, a second median plane, which can extend vertically through the dashed line 113*b* illustrated on the top view of FIG. 2B and the bottom view of FIG. 2C, can define a front-half of the tray 102 and a back-half of the tray 102. In other words, the second median plane can vertically extend through the mid-width (e.g., between the third end 112*c* and the fourth end 112*c*) of the tray 102.

Continuing with FIGS. 2A-2G, the tray 102 can include one or more sidewalls 114 (e.g., 114*a*, 114*b*, 114*c*, 114*d*). The one or more sidewalls 114 can extend downwards from the base 106 and/or the top surface 108 of the tray 102. In some instances, the sidewalls 114 can be located at the ends 112 of the base 106. For example, the first end 112*a* can include a first sidewall 114*a*, the second end 112*b* can include a second sidewall 114*b*, the third end 112*c* can include a third sidewall 114*c*, and/or a fourth end 112*d* can include a fourth sidewall 114*d*. In some instances, the sidewall 114 can be continuous around the base 106 of the tray 102.

Each sidewall 114 can define an outer surface 116 (e.g., 116*a*, 116*b*, 116*c*, 116*d*). In some instances, the outer surface 116 of the sidewall 114 can be substantially planar (e.g., flat). Similarly, each sidewall 114 can define an inner surface 118 (e.g., 118*a*, 118*b*, 118*c*, 118*d*) that is opposite the outer surface 116. In some instances, the inner surface 118 can be substantially planar. The distance between the outer surface 116 and the inner surface 118 can define a thickness of the sidewalls 114 of the tray 102. In some instances, the thickness of the sidewalls 114 can be relatively uniform (e.g., the outer surface 116 and inner surface 118 are both substantially planar and are parallel to each other). However, in other instances, the thickness of the sidewalls 114 can vary (e.g., non-uniform).

Each sidewall 114 can be substantially perpendicular to the base 106. In one example, when the top surface 108 of the base 106 is planar and the outer surface 116 and inner surface 118 of the sidewalls 114 are planar, the sidewalls 114 can be substantially perpendicular to the top surface 108. Therefore, when the planar top surface 108 of the tray 102 is parallel to a horizontal plane, the one or more sidewalls 114 can be substantially parallel to a vertical plane.

Figure 2D:
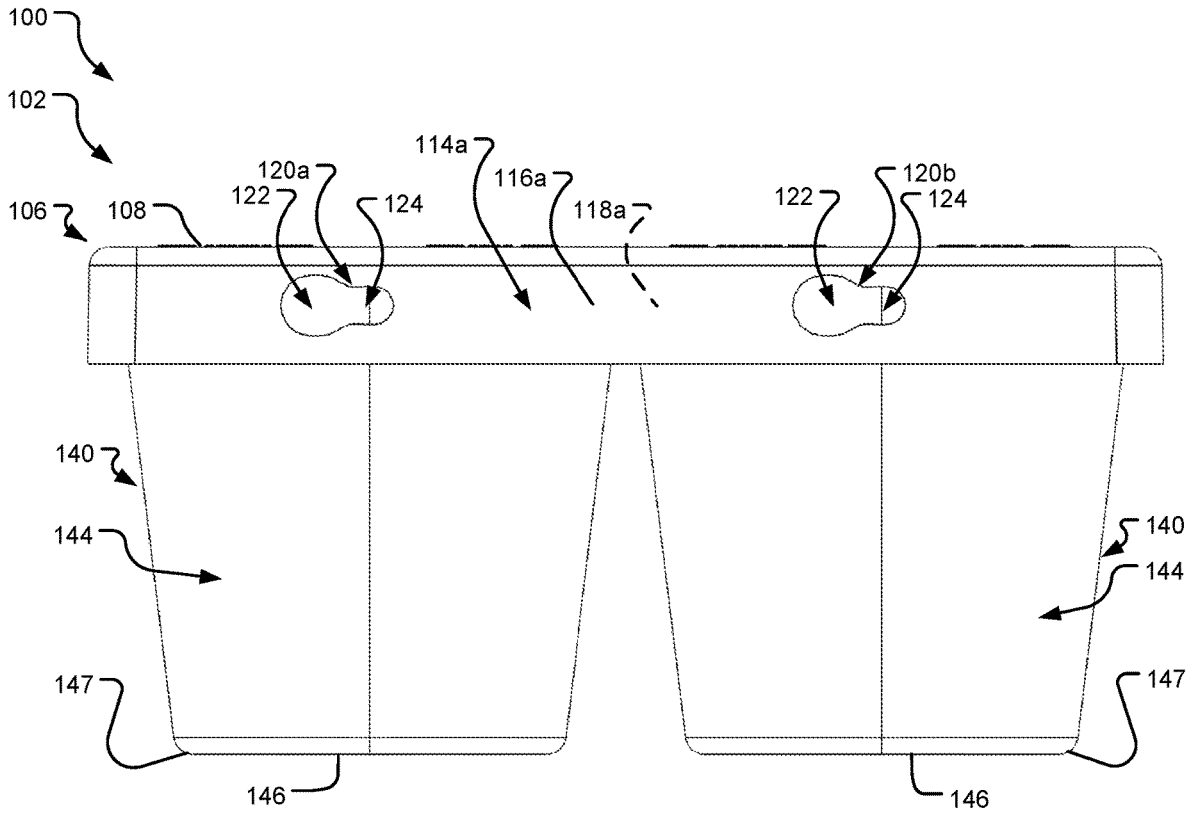

As illustrated in FIG. 2D, one or more tray-coupling apertures 120 (e.g., 120*a*, 120*b*) can extend through one or more sidewalls 114. In other words, each tray-coupling aperture 120 can extend through a sidewall 114 from the outer surface 116 to the inner surface 118. In some instances, a first tray-coupling aperture 120*a* and a second tray-coupling aperture 120*b* can extend through the first sidewall 114*a*, as illustrated in FIG. 2D, which is a side (e.g., left) view of the tray 102. In other instances (not shown in the figures), more than two tray-coupling apertures 120 (e.g., three, four, or five or more tray-coupling apertures 120) can extend through the sidewall 114. In some instances, the tray-coupling apertures 120 can be centered about the second median plane.

Each tray-coupling aperture 120 can correspond in size, shape, and position (e.g., the sidewall 114 across the tray 102) to a tray-coupling protrusion 126 (which are discussed below) of the tray 102. The tray-coupling apertures 120 of a first tray 102*a* can be configured to engage the tray-coupling protrusions 126 of a second tray 102*b*. This can removably couple a first tray 102*a* to a second tray 102*b*, as illustrated, for example, in FIGS. 1B-1C. Moreover, the tray-coupling apertures 120 of a first tray 102*a* can correspond in size, shape, and position to the tray-coupling apertures 120 of a second tray 102*b*.

Each tray-coupling aperture 120 can include a receiving borehole 122, as illustrated in FIG. 2D. The receiving borehole 122 can be in communication with a retaining borehole 124. The receiving borehole 122 can receive a tray-coupling protrusion 126. The retaining borehole 124 can retain the tray-coupling protrusion 126, which can removably couple a first tray 102*a* to a second tray 102*b*. In some instances, the cross-sectional shape of the receiving borehole 122 can be substantially circular, which can define both a center and a diameter of the receiving borehole 122. Similarly, the cross-sectional shape of the retaining borehole 124 can be substantially circular (e.g., semi-circular), which can define both a center and a diameter of the retaining borehole 124. In some instances, the diameter of the retaining borehole 124 can be less than the diameter of the receiving borehole 122. In some instances, a line segment connecting the center of the receiving borehole 122 to the center of the retaining borehole 124 can be horizontal when the top surface 108 of the tray 102 is facing upwards (e.g., when the top surface 108 is parallel with a horizontal plane).

Figure 2E:
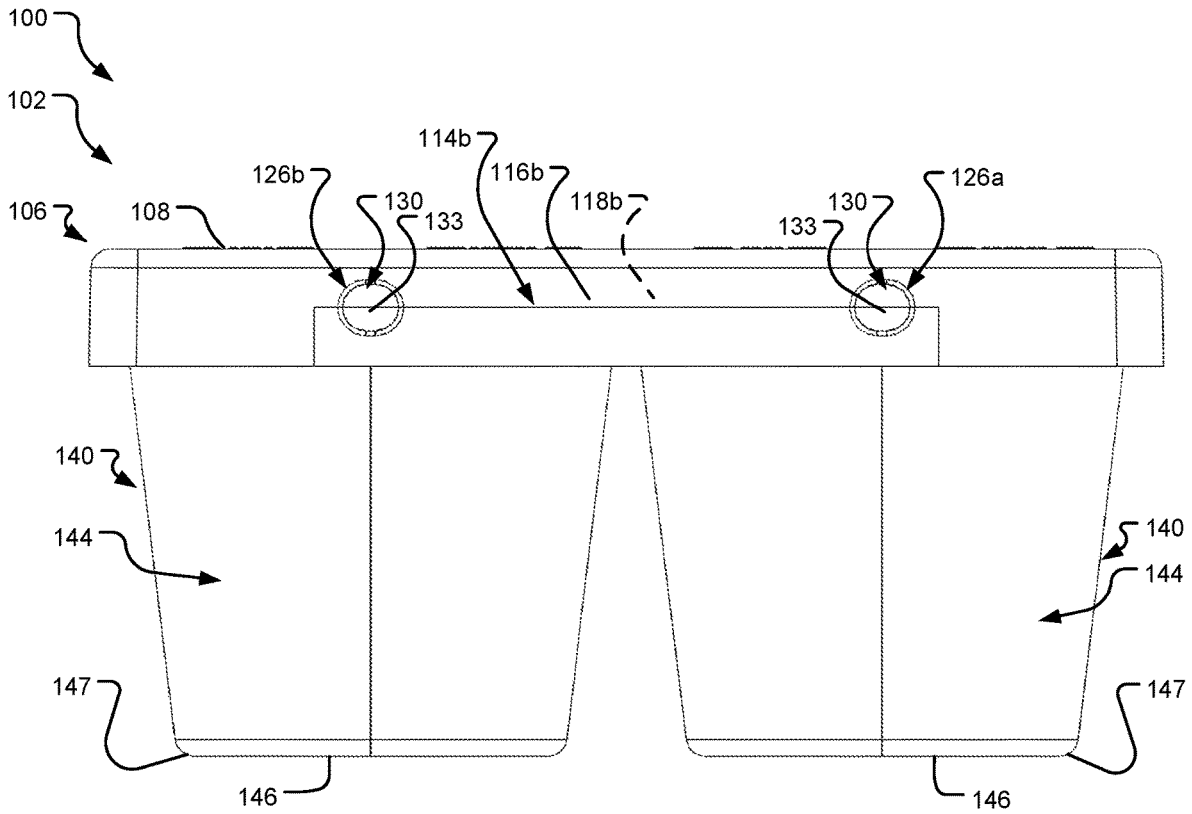

Continuing with FIGS. 2A-2G, one or more tray-coupling protrusions 126 (e.g., 126*a*, 126*b*) can extend outward from one or more sidewalls 114. For example, each tray-coupling protrusion 126 can extend outward from the outer surface 116 of a sidewall 114. In some instances, a first tray-coupling protrusion 126*a* and a second tray-coupling protrusion 126*b* can extend outward from the second sidewall 114*b*, as illustrated in FIG. 2E, which is a side (e.g., right) view of the tray 102. In other instances (not shown in the figures), more than two tray-coupling protrusions 126 (e.g., three, four, or five or more tray-coupling protrusions 126) can outward from the sidewall 114. In some instances, the tray-coupling protrusions 126 can be centered about the second median plane.

Each tray-coupling protrusion 126 can correspond in size, shape, and position (e.g., the sidewall 114 across the tray 102) to a tray-coupling aperture 120 of the tray 102, as discussed previously. The tray-coupling protrusions 126 of a second tray 102*b* can engage the tray-coupling apertures 120 of a first tray 102*a*. This can removably couple a second tray 102*b* to a first tray 102*a*, as illustrated in, for example, FIGS. 1B-1C. Moreover, the tray-coupling protrusions 126 of a first tray 102*a* can correspond in size, shape, and position to the tray-coupling protrusions 126 of a second tray 102*b*.

Each tray-coupling protrusion 126 can include a post 128 coupled to the sidewall 114, as illustrated in the top view of FIG. 2B and the bottom view of FIG. 2C. The post 128 can define a longitudinal axis along its length, which can be the distance measured between the outer surface 116 of the sidewall 114 and the head 130. The cross-sectional shape of the post 128 can be substantially circular, which can define a diameter of the post 128. In other words, the post 128 can be substantially cylindrical in shape and, accordingly, can define an outer cylindrical surface of the post 128. In some instances, the diameter of the post 128 can be smaller and/or substantially the same as the diameter of the retaining borehole 124 of the tray-coupling aperture 120.

A head 130 can be coupled to the opposite end of the post 128 (e.g., opposite the sidewall 114), as illustrated in the top view of FIG. 2B and the bottom view of FIG. 2C. The head 130 can define a longitudinal axis along its thickness, which can be measured between an inner-facing surface 131 of the head 130 and an outer facing-surface 133 of the head 130. The inner-facing surface 131 and/or outer facing-surface 133 of the head 130 can be substantially planar (e.g., flat). In some instances, the longitudinal axis of the head 130 can be coincident with the longitudinal axis of the post 128. The cross-sectional shape of the head 130 can be substantially circular, which can define diameter of the head 130. The diameter of the head 130 can be greater than the diameter of the post 128. Additionally, the diameter of the head 130 can be less than the diameter of the receiving borehole 122 and greater than the diameter of the retaining borehole 124 of the tray-coupling aperture 120.

A rib 132 (e.g., reinforced connector piece) can extend radially outward from the post 128, as illustrated in the top view of FIG. 2B and the bottom view of FIG. 2C. One end of the rib 132 can be coupled to the head 130 (e.g., inner facing surface of the head 130). The other end of the rib 132 can be coupled to the sidewall 114 of the tray 102. The rib 132 can reinforce the tray-coupling protrusion 126 (e.g., add rigidity and increase structural support for the post 128 and head 130). The rib 132 can be located on the opposite side of the post 128 from the side of the post 128 that engages the retaining borehole 124. In other words, the rib 132 of the tray-coupling protrusion 126 can face towards the receiving borehole 122 to allow the tray-coupling protrusion 126 to slidably engage with a tray-coupling aperture 120 of a second tray 102.

FIGS. 3A-3G illustrate one instance of a first tray 102*a* being removably coupled to a second tray 102*b*. The tray-coupling protrusions 126 of the first tray 102*a* can engage the tray-coupling apertures 120 of the second tray 102*b* to removably couple the first tray 102*a* to the second tray 102*b*. The longitudinal axis of each post 128 and/or head 130 of each tray-coupling protrusion 126 of the first tray 102*a* can be substantially aligned with the center of the each receiving borehole 122 of each tray-coupling aperture 120 of the second tray 102*b*, as illustrated, for example, in the top view in FIG. 3A and the perspective-top view in FIG. 3B. The top surface 108 of the first tray 102*a* can be substantially planar to (e.g., substantially co-planar with) the top surface 108 of the second tray 102*b*. Similarly, the outer surface 116 of the sidewall 114 of the first tray 102*a* can be substantially parallel to the outer surface 116 of the sidewall 114 of the second tray 102*b*.

Figure 3A:
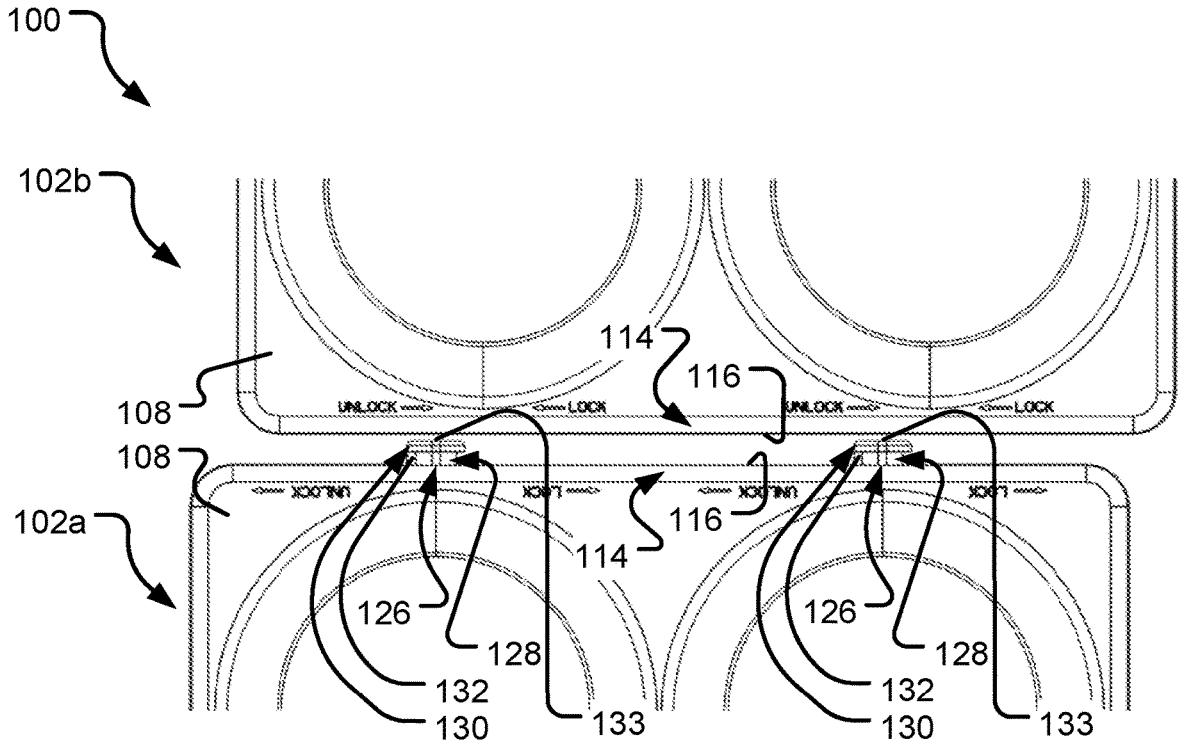
FIGS. 3A-3G illustrate one instance of a first tray being removably coupled to a second tray.
Figure 3B:
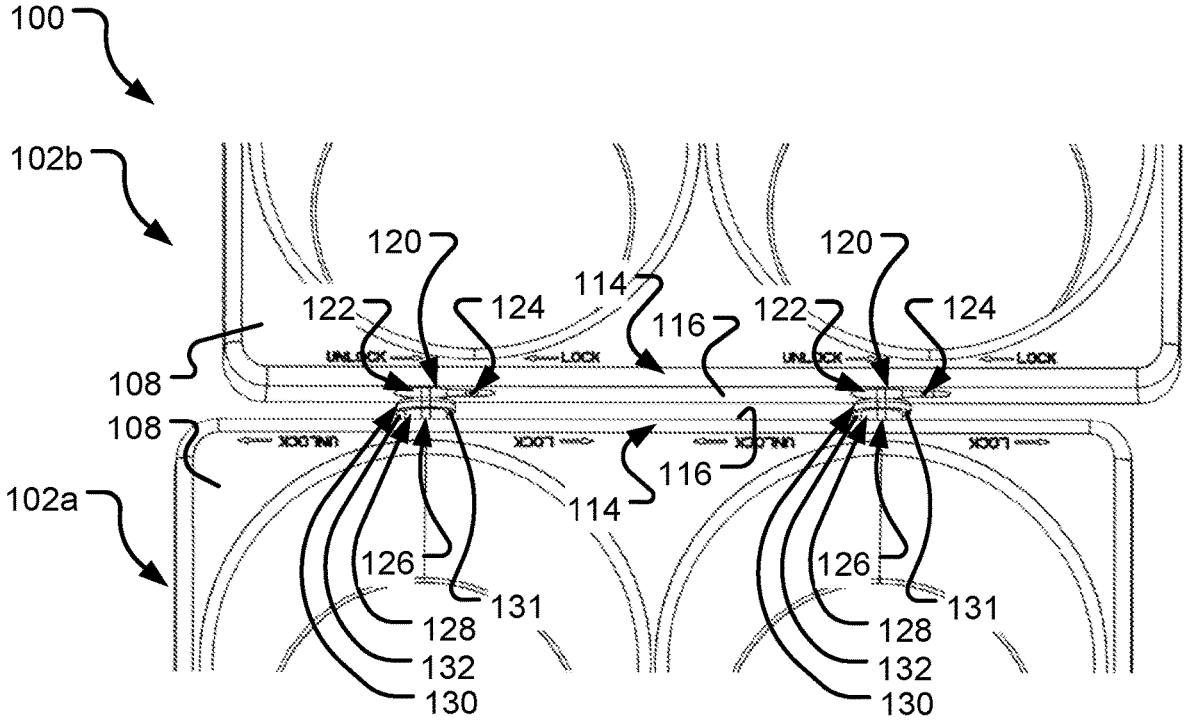
Figure 3C:
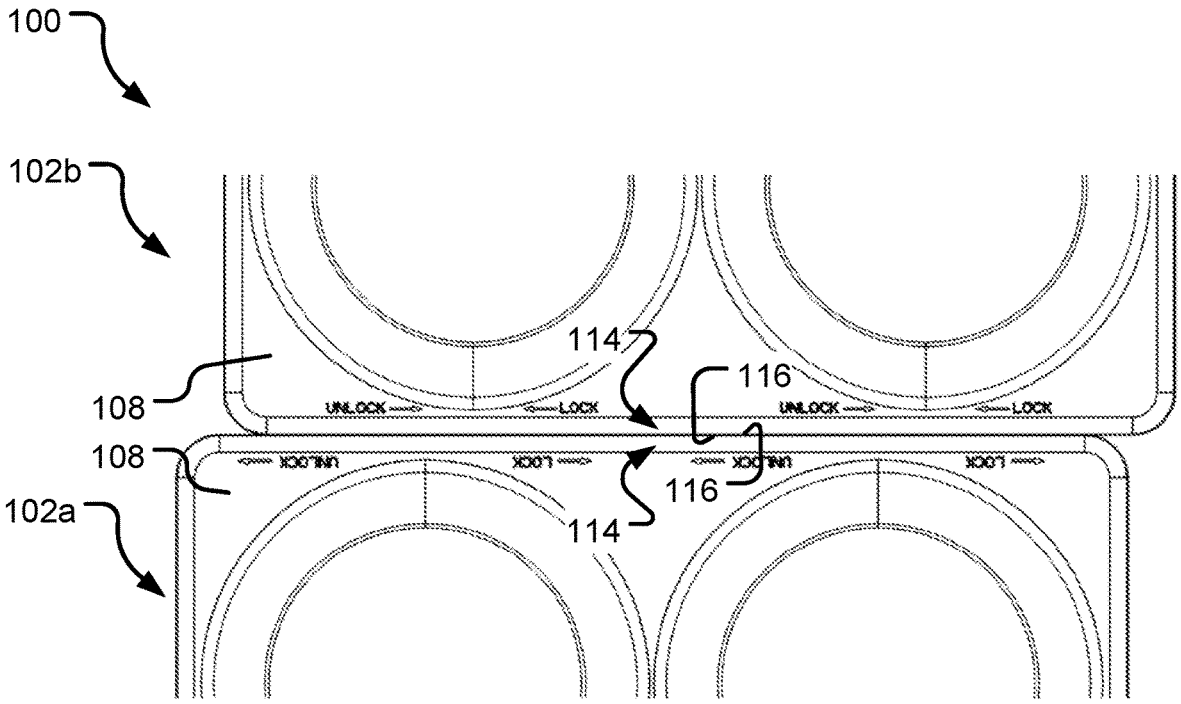
Figure 3D:
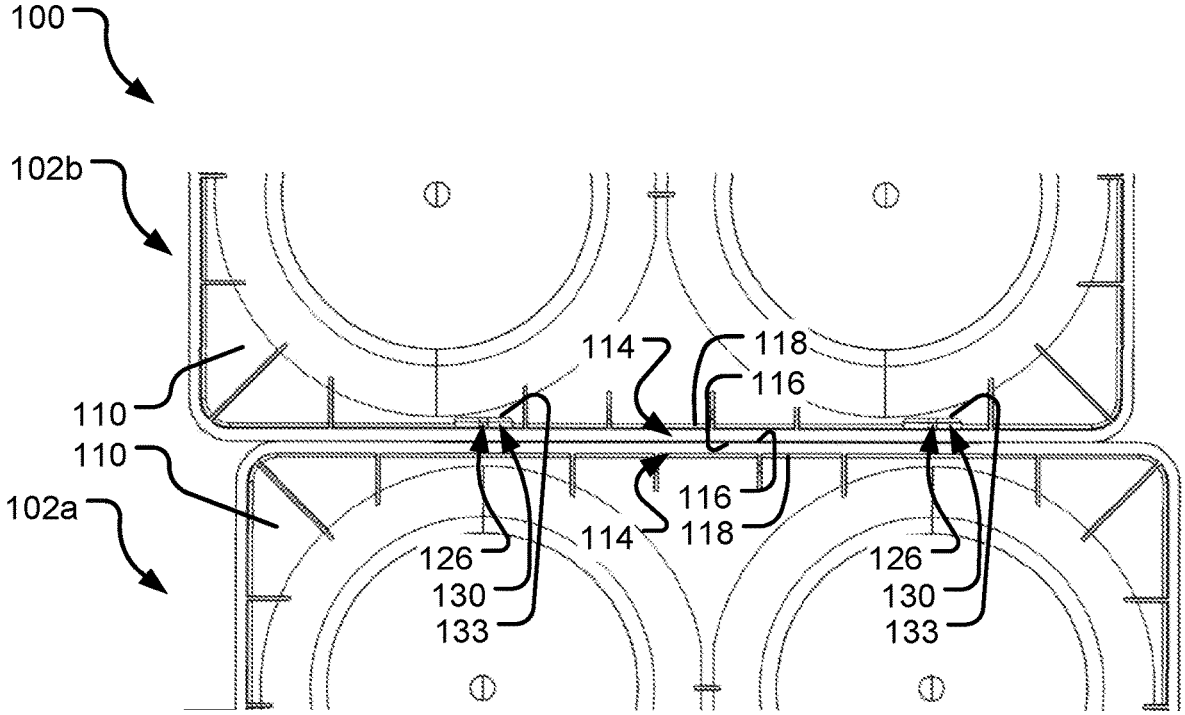

Each head 130 of each tray-coupling protrusion 126 of the first tray 102*a* can be advanced (e.g., inserted) through each receiving borehole 122 of each tray-coupling apertures 120 of the second tray 102*b*, as illustrated, for example, in the top view in FIG. 3C and bottom view in FIG. 3D. The outer surface 116 of the sidewall 114 of the first tray 102*a* can be in contact with the outer surface 116 of the sidewall 114 of the second tray 102*b*. In some instances, the outer surface 116 of the sidewall 114 of the first tray 102*a* can be substantially parallel to the sidewall 114 of the second tray 102*b*. In some instances, the outer surface 116 of the sidewall 114 of the first tray 102*a* can be co-planar with the sidewall 114 of the second tray 102*b*.

Figure 3E:
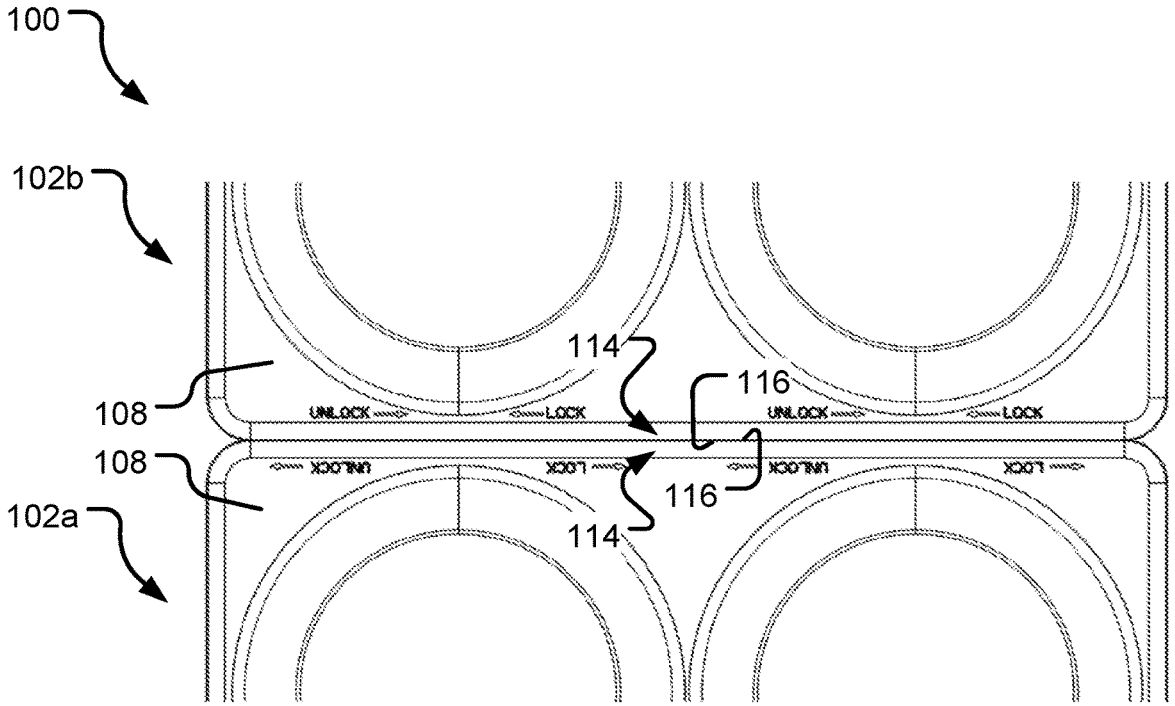
Figure 3F:
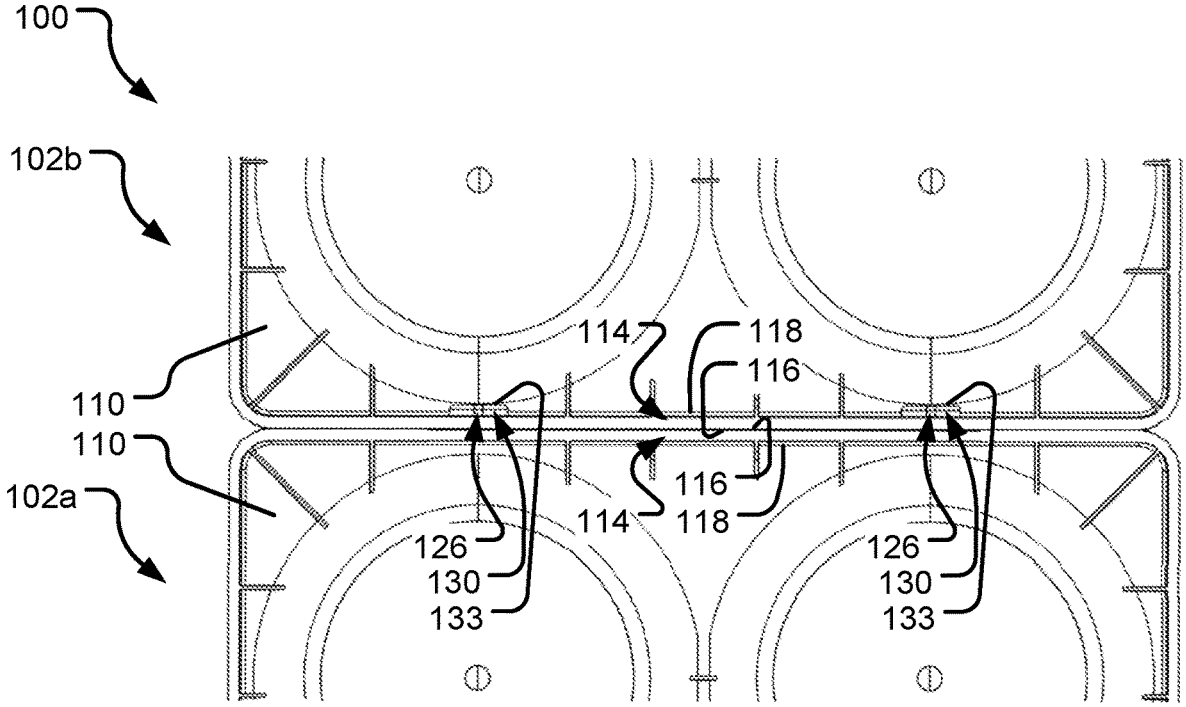
Figure 3G:
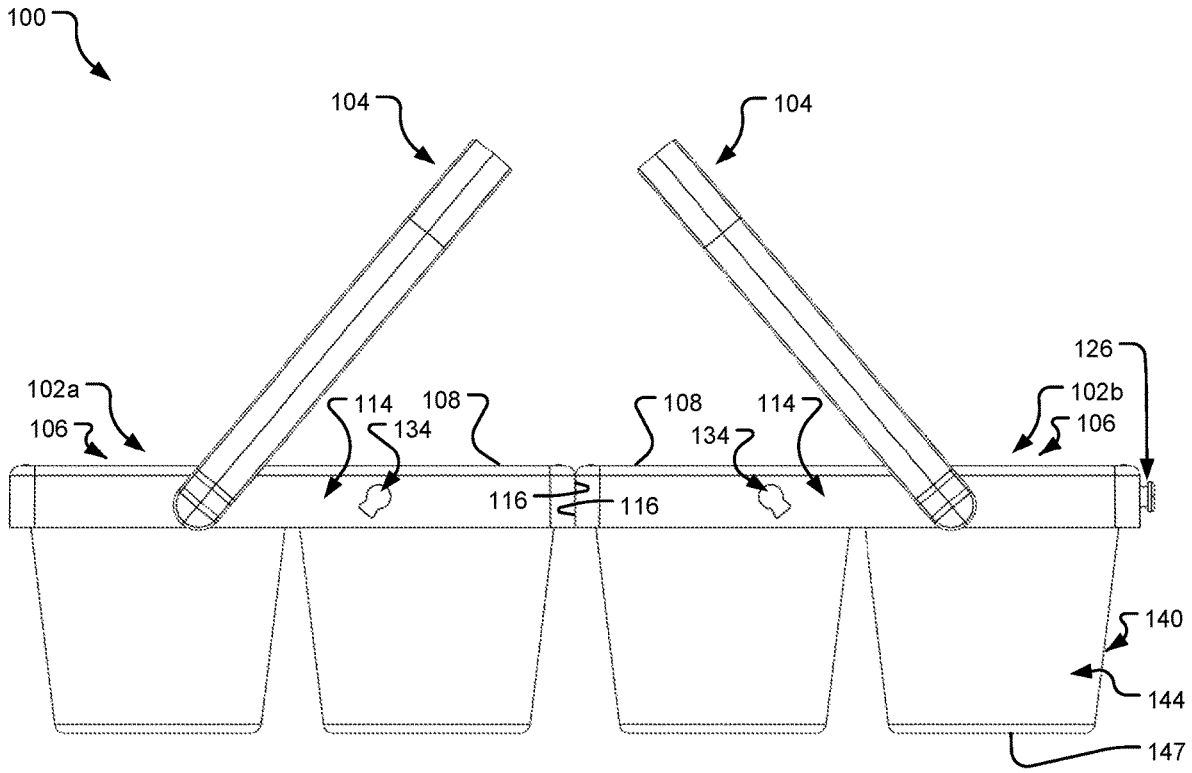

The first tray 102*a* and second tray 102*b* can be slidably engaged with respect to each other, so that each post 128 of each tray-coupling protrusion 126 of the first tray 102*a* engages the retaining borehole 124 of each tray-coupling aperture 120 of the second tray 102*b*, as illustrated, for example, in the top view in FIG. 3E and bottom view FIG. 3F. The top surface 108 of each tray 102*a*, 102*b* can include one or more markings (e.g., embossed onto or debossed into the top surface 108) indicating the direction to slidably engage (e.g., lock) and/or slidably disengage (e.g., unlock) the trays 102*a*, 102*b*. For example, slidably engaging the trays 102*a*, 102*b* can include slidably engaging each post 128 of the first tray 102*a* into each retaining borehole 124 of the second tray 102*b*. On the other hand, slidably disengaging the trays 102*a*, 102*b* can include slidably disengaging each post 128 of the first tray 102*a* from each retaining borehole 124 of the second tray 102*b* (e.g., each post 128 is slid away from each retaining borehole 124 and to each receiving borehole 122). Each head 130 can be backed out (e.g., withdrawn) from each receiving borehole 122 to decouple (e.g., detach) the first tray 102*a* from the second tray 102*b*.

Continuing with FIGS. 3A-3G, when the first tray 102*a* is removably coupled to the second tray 102*b*, the surface of the posts 128 (e.g., outer cylindrical surface) of the tray-coupling protrusions 126 of the first tray 102*a* can be in contact with the interior surface of the retaining boreholes 124 of the tray-coupling apertures 120 of the second tray 102*b* (e.g., the diameter of the posts 128 can be substantially the same as the diameter of the retaining boreholes 124).

Additionally, when the trays 102*a*, 102*b* are removably coupled together, the outer surface 116 of the sidewall 114 of the first tray 102*a* can be in contact with (e.g., co-planar with) the outer surface 116 of the sidewall 114 of the second tray 102*b*. In some instances, the planar outer surfaces 116 of the sidewalls 114 of each tray 102*a*, 102*b* can be co-planar.

Additionally, when the trays 102*a*, 102*b* are removably coupled together, the inner-facing surface 131 of each head 130 of each tray-coupling protrusion 126 of the first tray 102*a* can be in contact with (e.g., co-planar with) the inner surface 118 of the sidewall 114 of the second tray 102*b* (e.g., the diameter of each head 130 can be greater than the diameter of each retaining borehole 124). In some instances, the length of each post 128 (e.g., defined from the outer surface 116 of the sidewall 114 to the inner-facing surface 131 of the head 130) of the first tray 102*a* can be substantially the same as the thickness of the sidewall 114 of the second tray 102*b*.

Continuing with FIGS. 3A-3G, one or more surfaces of the first tray 102*a* can abut one or more surfaces of the second tray 102*b* when the trays 102*a*, 102*b* are removably coupled together, as discussed in the preceding paragraphs. The posts 128 of the first tray 102*a* can abut the retaining boreholes 124 of the second tray 102*b*, the sidewall 114 of the first tray 102*a* can abut the sidewall of the second tray 102*b*, and/or each head 130 of can abut the sidewall 114 of the second tray 102*b*.

The abutting surfaces can be configured to inhibit rotation between the trays 102*a*, 102*b*. Additionally, the abutting surfaces can be configured to cause the planar top surface 108 of the first tray 102*a* to remain substantially planar to the planar top surface 108 of the second tray 102*b* (e.g., co-planar), as illustrated, for example, in FIG. 3G, which is a side view illustrating a first tray 102*a* removably coupled to a second tray 102*b*. Additionally, the abutting surfaces can be configured to cause the planar sidewall 114 of the first tray 102*a* and the planar sidewall 114 of the second tray 102*b* to remain substantially planar (e.g., co-planar). Even when external forces are applied to the trays 102*a*, 102*b* (e.g., when handles 104 are removably coupled to the trays 102*a*, 102*b* and a user is transporting the trays 102*a*, 102*b* by the handles 104), the abutting surfaces 116, 116 can inhibit rotation between the trays 102*a*, 102*b*, cause the top surfaces 108, 108 to remain substantially planar (e.g., co-planar), and/or cause the sidewalls 114, 114 to remain substantially planar (e.g., co-planar).

Figure 2F:
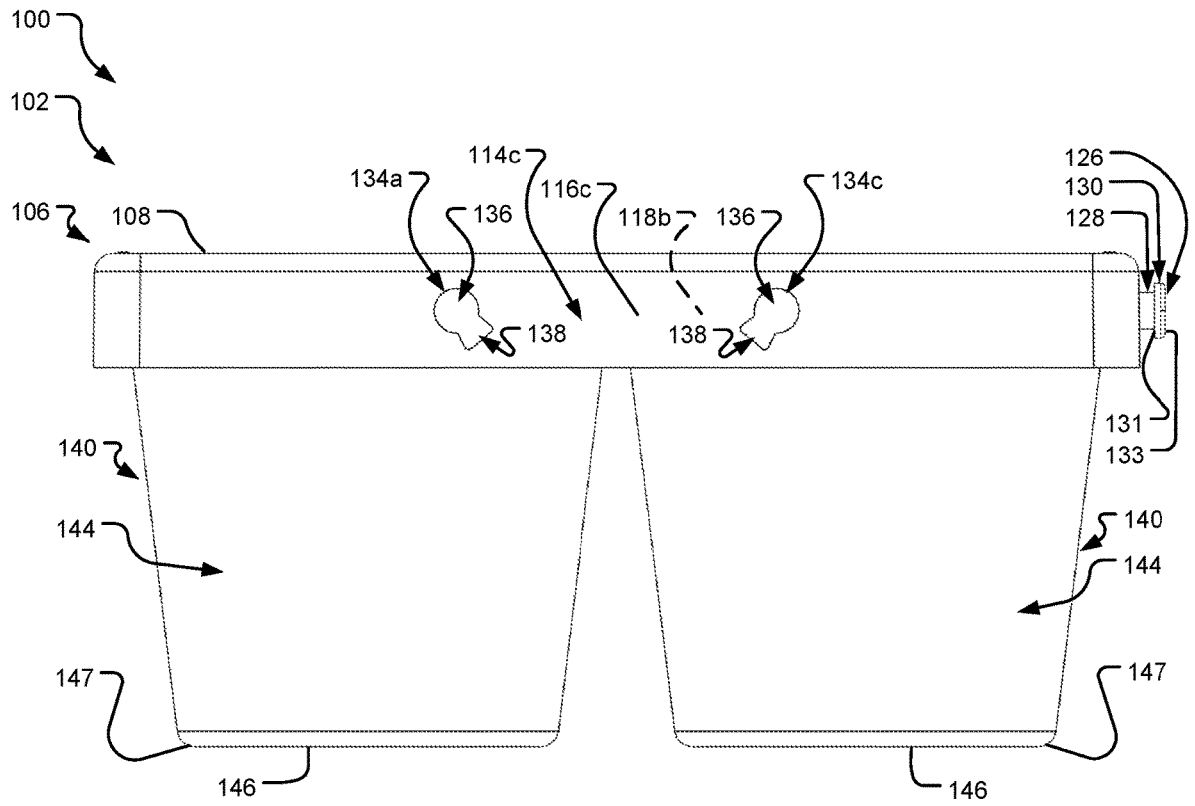

Returning to FIGS. 2A-2G, one or more handle-mounting apertures 134 (e.g., 134*a*, 134*b*, 134*c*, 134*d*) can extend through one or more sidewalls 114 of the tray 102. In other words, each handle-mounting aperture 134 can extend through a sidewall 114 from the outer surface 116 to the inner surface 118. The handle-mounting apertures 134 can be oriented in pairs (e.g., groups of two), with each handle-mounting apertures 134 being on opposite sides of the tray 102 to engage a handle (which is discussed below). In some instances, a first pair of handle-mounting apertures 134 can include a first handle-mounting aperture 134*a* on the opposite side of the tray 102 from a second handle-mounting aperture 134*b*. For example, a first handle-mounting aperture 134*a* can extend through the third sidewall 114*c*, as illustrated in FIG. 2F which is a side (e.g., front) view of the tray 102. A corresponding second handle-mounting aperture 134*b* can extend through the fourth sidewall 114*d*, as illustrated in FIG. 2G which is a side (e.g., back) view of the tray 102.

In some instances, a second pair of handle-mounting apertures 134 can include a third handle-mounting aperture 134*c* on the opposite side of the tray 102 from a fourth handle-mounting aperture 134*d*. For example, a third handle-mounting aperture 134*c* can extend through the third sidewall 114*c*, as illustrated in the side (e.g., front) view of FIG. 2F. A corresponding a fourth handle-mounting aperture 134*d* can extend through the fourth sidewall 114*d*, as illustrated in the side (e.g., back) view in FIG. 2G. In other instances (not shown in the figures), more than two pairs of handle-mounting apertures 134 (e.g., three pairs, four pairs, or five or more pairs) can extend through the sidewall 114. In some instances, the handle-mounting apertures 134 can be centered about the first median plane. In some instances, each pair of handle-mounting apertures 134 can be reflected across the second median plane (e.g., opposite sidewalls).

Each handle-mounting aperture 134 can correspond in size and shape to a handle-mounting protrusion 158 (which are discussed below) of the handle 104. The handle-mounting apertures 134 of a tray 102 can be configured to engage the handle-mounting protrusions 158 of a handle 104. This can removably couple the handle 104 to the second tray 102, as illustrated, for example, in FIGS. 1B-1C.

Figure 2G:
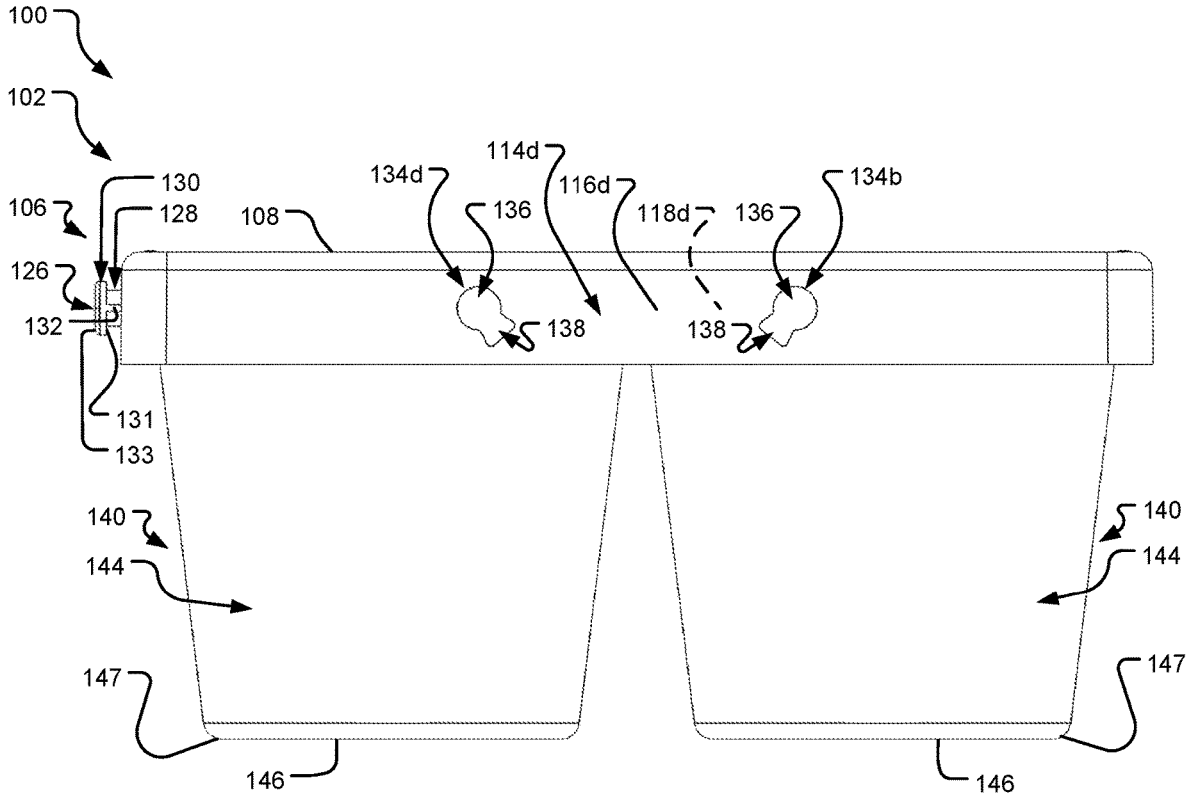

Each handle-mounting aperture 134 can include a borehole 136, as illustrated in FIGS. 2F-2G. The borehole 136 can be in communication with a keyway 138. The borehole 136 and keyway 138 can receive and retain a handle-mounting protrusion 158, which can removably couple the tray 102 to the handle 104. In some instances, the cross-sectional shape of the borehole 136 can be substantially circular, which can define both a center and a diameter of the borehole 136. The cross-sectional shape of the keyway 138 can be substantially rectangular, which can define a width, a length, and a center of the keyway 138. In some instances, a line segment connecting the center of the borehole 136 to the center of the keyway 138 (e.g., along the midline of the keyway 138) can be at an approximately 45-degree angle with respect to a horizontal plane and approximately a 45-degree angle with respect to a vertical plane when the top surface 108 of the tray 102 is facing upwards (e.g., when the top surface 108 is parallel with a horizontal plane). In some instances, the keyway 138 can be oriented downward (e.g., towards the bottom of the sidewall 114) and inward (e.g., towards the first median plane plane) from the borehole 136 when the top surface 108 of the tray 102 is parallel with a horizontal plane. In some instances (not shown in the figures), the keyway 138 can be oriented downward and outward (e.g., away from the first median plane plane) from the borehole 136 when the top surface 108 of the tray 102 is parallel with a horizontal plane.

Continuing with FIGS. 2A-2G, the tray 102 can include one or more cup holders 140 (e.g., 140*a*, 140*b*, 140*c*, 140*d*) extending through the base 106 of the tray 102. Each cup holder 140 can receive and retain an object such as, for example, a cup (not shown in FIGS. 2A-2G). After one or more cup holders 140 receives an object, the cup holder assembly 100 can be used to carry, move, or otherwise transport the object or objects (e.g., the user can carry the cup holder assembly 100 by the tray(s) 102 and/or handle(s) 104). The tray 102 can include, for example, four cup holders 140 extending therethrough. However, in other examples (not shown in the figures), the tray 102 can include more or less than four cup holders (e.g., one cup holder, two cup holders, three cup holders, five cup holders, six cup holders, seven cup holders, eight cup holders, or nine or more cup holders).

Each cup holder 140 can define a circular opening 142 through the top surface 108 of the tray 102, as illustrated, for example, in the top view in FIG. 2B. The circular opening 142 of each cup holder 140 can be substantially circular in shape and can define a diameter of the cup holder 140 at the top surface 108. In some instances, the diameter of all of the circular openings 142 in a tray 102 can be uniform. However, in other instances (not shown in the figures), the diameter of some of the circular openings 142 in a tray 102 can vary (e.g., non-uniform). In some examples, the diameter of the circular openings 142 can be within a range from approximately 2.5-inches to approximately 5.5-inches. In some examples, the diameter can be within a range from approximately 3.5-inches to approximately 4.5-inches. In one example, the diameter can be approximately 4-inches.

Continuing with FIGS. 2A-2G, each cup holder 140 can include a sidewall 144. The sidewall 144 can define an outer surface and an inner surface. The distance between the inner surface and the outer surface of the sidewall 144 can define a thickness of the sidewall 144 of the cup holder 140. In some instances, the thickness of the sidewall 144 can be relatively uniform. However, in other instances, the thickness of the sidewall 144 can vary (e.g., non-uniform). The interface between the inner surface of the sidewall 144 and the top surface 108 of the tray 102 (e.g., at the circular opening 142) can be beveled (e.g., quarter round), which can define a radius (e.g., of the rounded corner).

In some instances, one or more sidewalls 144 can be oblique to the top surface 108 of the tray 102 (e.g., the sidewalls 144 can be angled with respect to a vertical axis when the top surface 108 of the tray is facing upwards). For example, the cup holder 140 can be frusto-conical in shape. In other instances (not shown in the figures), one or more sidewalls 144 can be perpendicular to the top surface 108 of the tray 102 (e.g., the sidewalls 144 can be perpendicular to a vertical axis when the top surface 108 of the tray is facing upwards). For example (not shown in the figures), the cup holder 140 can be cylindrical in shape.

Continuing with FIGS. 2A-2G, each cup holder 140 can include a bottom wall 146. The bottom wall 146 can define an outer surface and an inner surface. The distance between the inner surface and the outer surface of the bottom wall 146 can define a thickness of the bottom wall 146 of the cup holder 140. In some instances, the thickness of the bottom wall 146 can be relatively uniform. However, in other instances, the thickness of the bottom wall 146 can vary (e.g., non-uniform). The bottom wall 146 can be coupled to a sidewall 144 of the cup holder 140. The inner surface of the bottom wall 146 can be in communication with the inner surface of the sidewall 144 and the outer surface of the bottom wall 146 can be in communication with the outer surface of the sidewall 144.

The bottom wall 146 can define a diameter of the bottom of the cup holder 140 of the tray 102. In some examples, the diameter of the bottom wall 146 can be within a range from approximately 2-inches to approximately 4-inches. In some examples, the diameter can be within a range from approximately 2.5-inches to approximately 3.5-inches. In one example, the diameter can be approximately 3-inches. The bottom wall 146 can define a circular edge 147 that is coupled to the sidewall 144. In some instances, the interface between the outer surface of the sidewall 144 and the outer surface of the bottom wall 146 of the cup holder 140 (e.g., at the circular edge 147) can be beveled (e.g., quarter round), which can define a radius (e.g., of the rounded corner).

The tray 102 can define a height, which can be the distance measured the top surface 108 of the tray 102 and the bottom end of the sidewall 144 of the cup holder 140 (e.g., the outer surface of the bottom wall 146 of the cup holder 140). In some examples, the height of the tray 102 can be within a range from approximately 3-inches to approximately 5.5-inches. In some examples, the height can be within a range from approximately 3.5-inches to approximately 5-inches. In one example, the height can be approximately 4.25-inches.

Figure 4A:
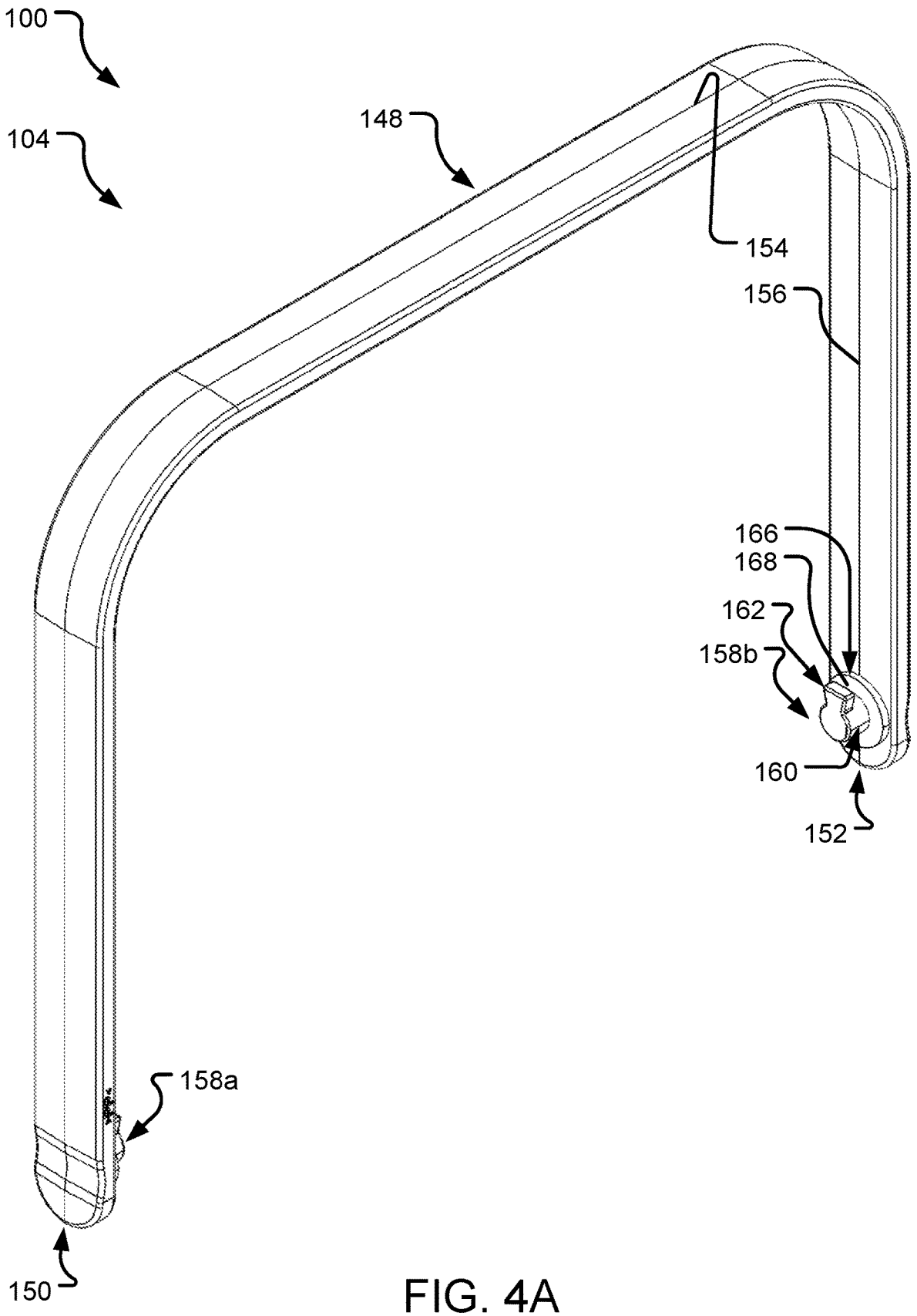
FIGS. 4A-4D illustrate one instance of a handle.

FIGS. 4A-4D illustrate one instance of a handle 104, which can be removably coupled to a tray 102 in a modular cup holder assembly 100. The handle 104 can be made out of polymer. For example, the handle 104 can be made out of thermoplastic. Specifically, as non-limiting examples, the handle 104 can be made out of acrylonitrile butadiene styrene (ABS), acrylic, engineered thermoplastics, decorative film laminates, polyethylene (PE), polypropylene (PP), polystyrene (PS), and/or polyvinyl chloride (PVC). The handle 104 can include one or more markings (e.g., embossed onto or debossed into any surface of the handle 104) indicating the material of the handle 104. In one instance, the handle can include a "PP" marking to indicate that it is made out of polypropylene. For example, the "PP" marking can be located on a surface of the handle 104, as illustrated in FIG. 4A.

Each handle 104 can include an elongated body 148 (e.g., a strap), as illustrated, for example, in FIG. 4A, which is a perspective view of a handle 104. The elongated body 148 can have a first end 150, a second end 152 opposite the first end 150, and a longitudinal axis. In some instances, handle 104 may include pre-bent corners (e.g., 90-degree angles between a horizontal portion of the handle 104 and the vertical portions of the handle 104), which can be spaced apart at substantially the width of the tray (not shown in FIGS. 4A-4D). In some instances, the handle 104 can be substantially rigid. In other instances, the handle 104 can be flexible, allowing it to be bent or manipulated. The elongated body 148 of the handle 104 can be configured to be transport the cup holder assembly 100 when the handle 104 is removably coupled to the tray 102 (e.g., a user can hold one or more handles 104 to transport the tray 102).

Each handle 104 can define an outer surface 154 and an inner surface 156 opposite the outer surface 154. The distance between the outer surface 154 and the inner surface 156 can define a thickness of the handle 104. In some examples, the thickness of the handle 104 can be within a range from approximately 0.150-inches to approximately 0.300-inches. In one example, the thickness can be approximately 0.197-inches. In some examples, the thickness may be within a range from approximately 0.200-inches to approximately 0.250-inches. In one example, the thickness can be approximately 0.236-inches.

Continuing with FIGS. 4A-4D, a handle-mounting protrusion 158 (e.g., 158*a*, 158*b*) can extend from each respective end (e.g., the first end 150 and the second end 152) of the handle 104. For example, as illustrated in FIG. 4A, a first handle-mounting protrusion 158*a* can extend from the handle 104 at the first end 150. A second handle-mounting protrusion 158*b* can extend from the handle 104 at the second end 152. The first handle-mounting protrusion 158*a* and the handle-mounting protrusion 158*b* can extend from the inner surface 156 of the handle 104.

Each handle-mounting protrusion 158 of the handle 104 can correspond in size and shape to a handle-mounting aperture 134 of the tray 102, as discussed previously. The handle-mounting protrusion 158 of a handle 104 can engage the handle-mounting aperture 134 of a tray 102. This can removably couple the handle 104 to the tray 102, as illustrated, for example, in FIGS. 1B-1C.

Figure 4B:
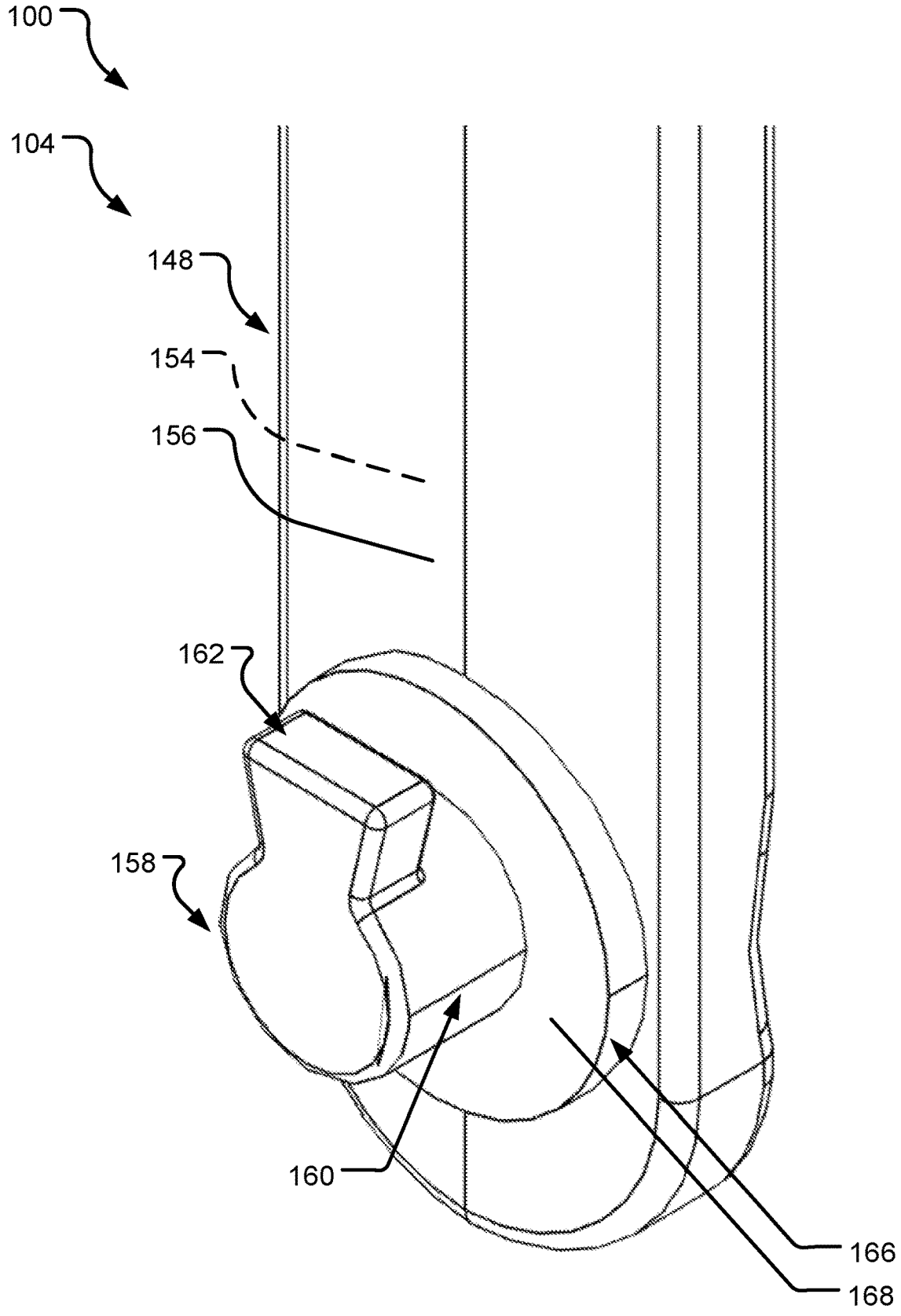

Each handle-mounting protrusion 158 can include a post 160, as illustrated, for example, in the FIG. 4B, which is a perspective view of a handle-mounting protrusion 158. The post 160 can extend outward from the inner surface 156 of the handle 104. The post can define a longitudinal axis along its length, and, in some instances, the longitudinal axis of the post 160 can be substantially perpendicular to the inner surface 156 from which it extends. The cross-sectional shape of the post 160 can be substantially circular, which can define a diameter of the post 160. In other words, the post 160 can be substantially cylindrical in shape and, accordingly, can define an outer cylindrical surface of the post 160. In some instances, the diameter of the post 160 can be smaller and/or substantially the same as the diameter of the borehole of the handle-mounting aperture of the tray (not shown in FIGS. 4A-4D).

A key 162 can be coupled to the opposite end of the post 160. The key 162 can extend radially outward from the post 160 (e.g., substantially perpendicular to the longitudinal axis of the post 160). The cross-sectional shape of the key 162 can be substantially rectangular, which can define a width, a length, and a center of the key 162. The cross-sectional shape and dimensions of the key 162 can be substantially the same as the cross-sectional shape and dimensions of the keyway of the handle-mounting aperture of the tray (not shown in FIGS. 4A-4D).

Figure 4C:
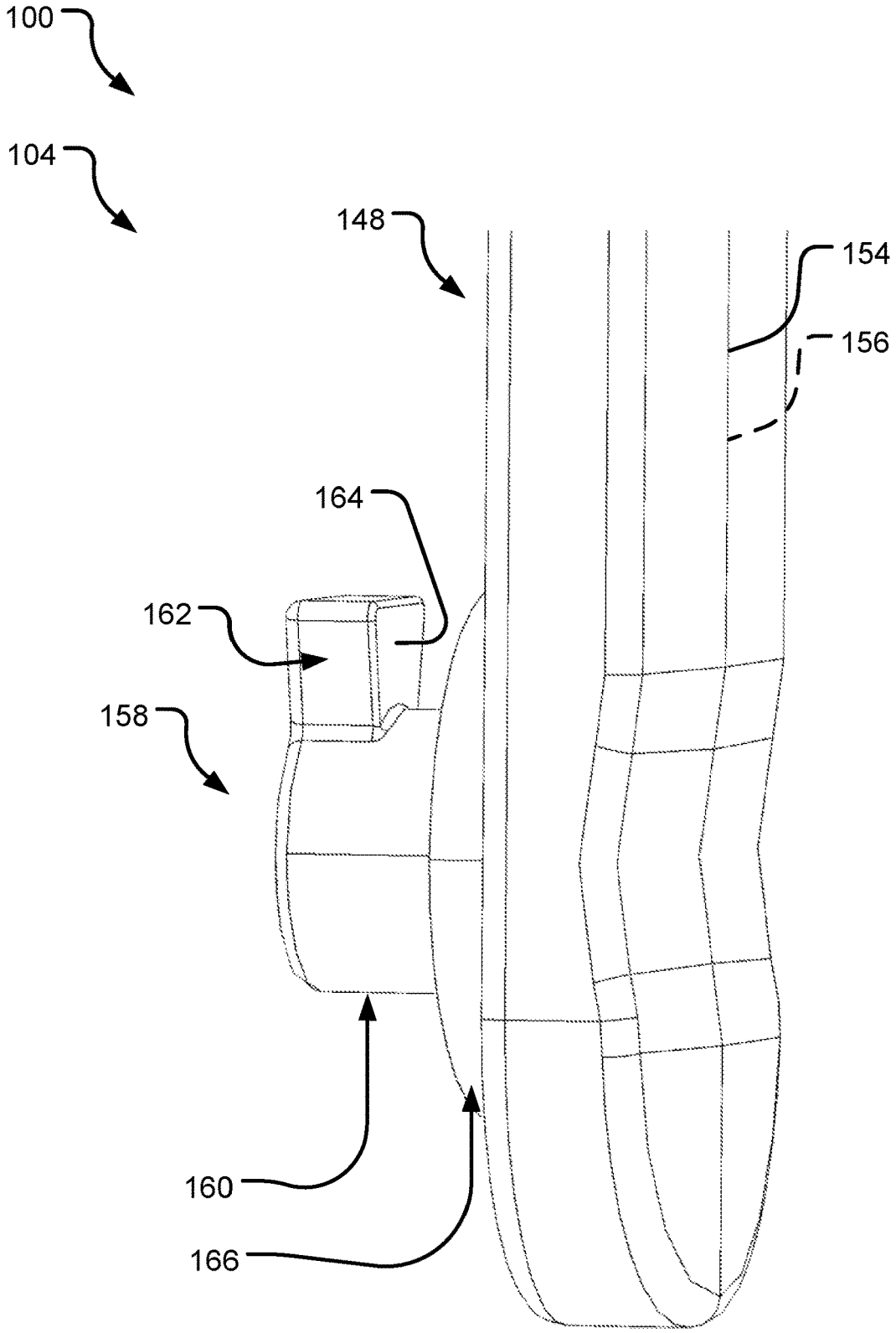
Figure 4D:
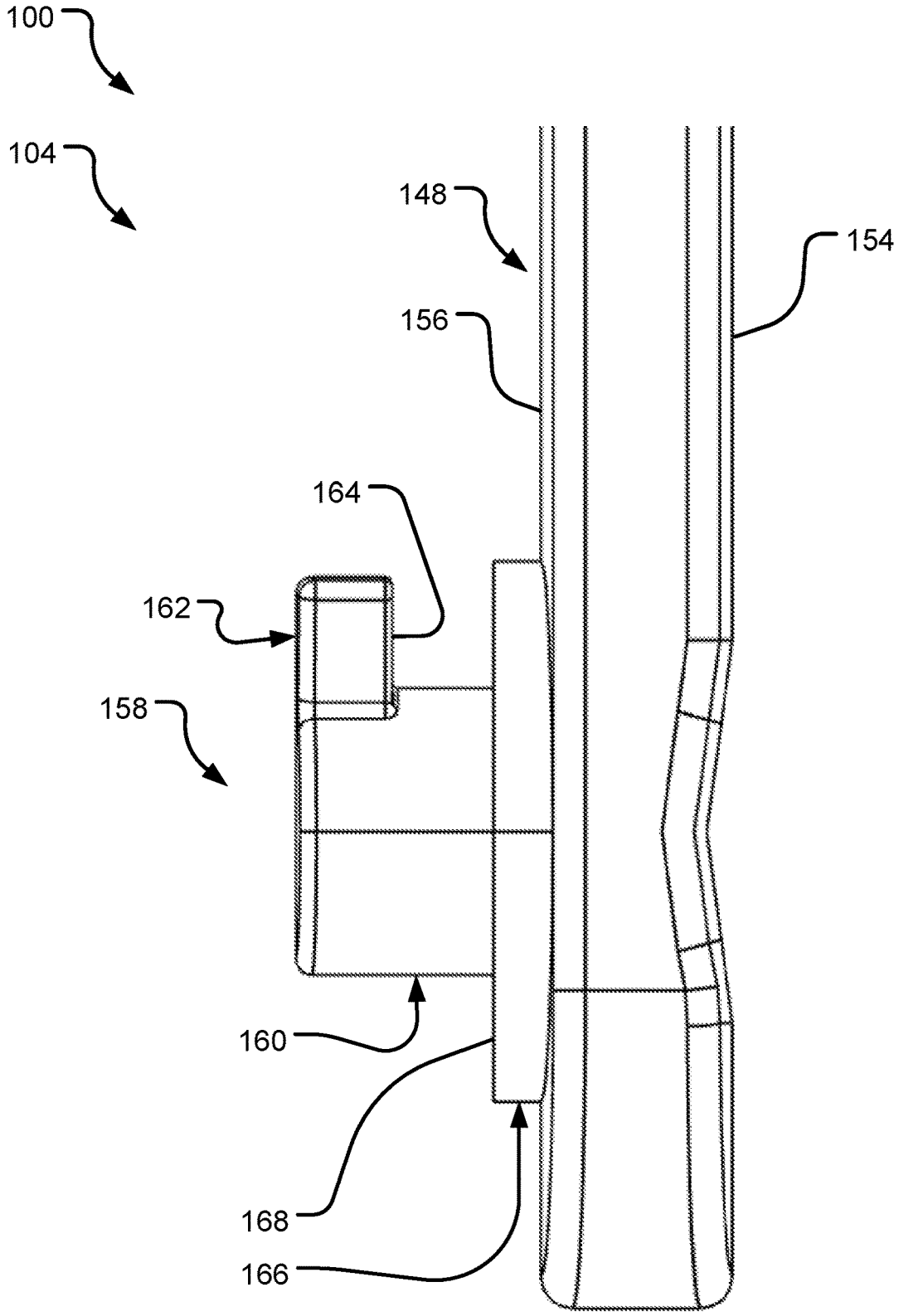

The key 162 can define an inner surface 164, as illustrated, for example, in FIG. 4C, which is a perspective view of a handle-mounting protrusion 158. The inner surface 164 of the key 162 can be substantially planar (e.g., flat). The inner surface 164 of the key 162 can be substantially parallel to the inner surface 156 of the handle 104 and/or inner surface 168 of a spacer 166 (which is discussed below), as illustrated, for example, in FIG. 4D, which is a side view of a handle-mounting protrusion 158.

A spacer 166 can be included at the inner surface 156 of the elongated body 148 of the handle 104. The spacer 166 can define an inner surface 168, which can be substantially planar (e.g., flat). The inner surface 168 can be substantially parallel to the inner surface 156 of the elongated body 148 of the handle 104. In some instances, the spacer 166 can be unitarily constructed as part of the handle 104 (e.g., the post 160 can extend from the spacer 166). The cross-sectional shape of the spacer 166 can be substantially circular, which can define a diameter of the spacer 166. The diameter of the spacer 166 can be greater than the diameter of the post 160. Additionally, the diameter of the spacer 166 can be greater than the diameter of the borehole of the handle-mounting aperture of the tray (not shown in FIGS. 4A-4D). The spacer 166 can be configured so that the handle 104 can rotate about the longitudinal axis of its handle-mounting protrusion 158 when the handle 104 is removably coupled to the tray.

FIGS. 5A-5F illustrate one instance of a handle 104 being removably coupled to a tray 102. The figures illustrate a handle-mounting protrusion 158 of the handle 104 engaging a handle-mounting aperture 134 of the tray 102. Because the handle-mounting protrusions 158 of the handle 104 and the handle-mounting apertures 134 of the tray 102 can be oriented in pairs (e.g., handle-mounting apertures 134 on opposite sides of the tray 102 and handle-mounting protrusions 158 at opposite ends of the handle 104), the process described below can be repeated to engage a second handle-mounting protrusion at the opposite end of the handle with a second handle-mounting aperture at the opposite side of the tray (not shown in FIGS. 5A-5F).

A handle-mounting protrusion 158 of the handle 104 can engage a handle-mounting aperture 134 of the tray 102 to removably couple the handle 104 to the tray 102. The longitudinal axis of the post 160 can be substantially aligned with the borehole 136 of the handle-mounting aperture 134, as illustrated, for example, in the top view in FIG. 5A and the perspective-top view in FIG. 5B. Similarly, the cross-sectional shape of the key 162 can be substantially aligned with the cross-sectional shape of the keyway 138 of the handle-mounting aperture 134. The inner surface 156 of the elongated body 148 of the handle 104 and/or the inner surface 168 of the spacer 166 of the handle 104 can be substantially parallel to the outer surface 116 of the sidewall 114 of the tray 102.

Figure 5A:
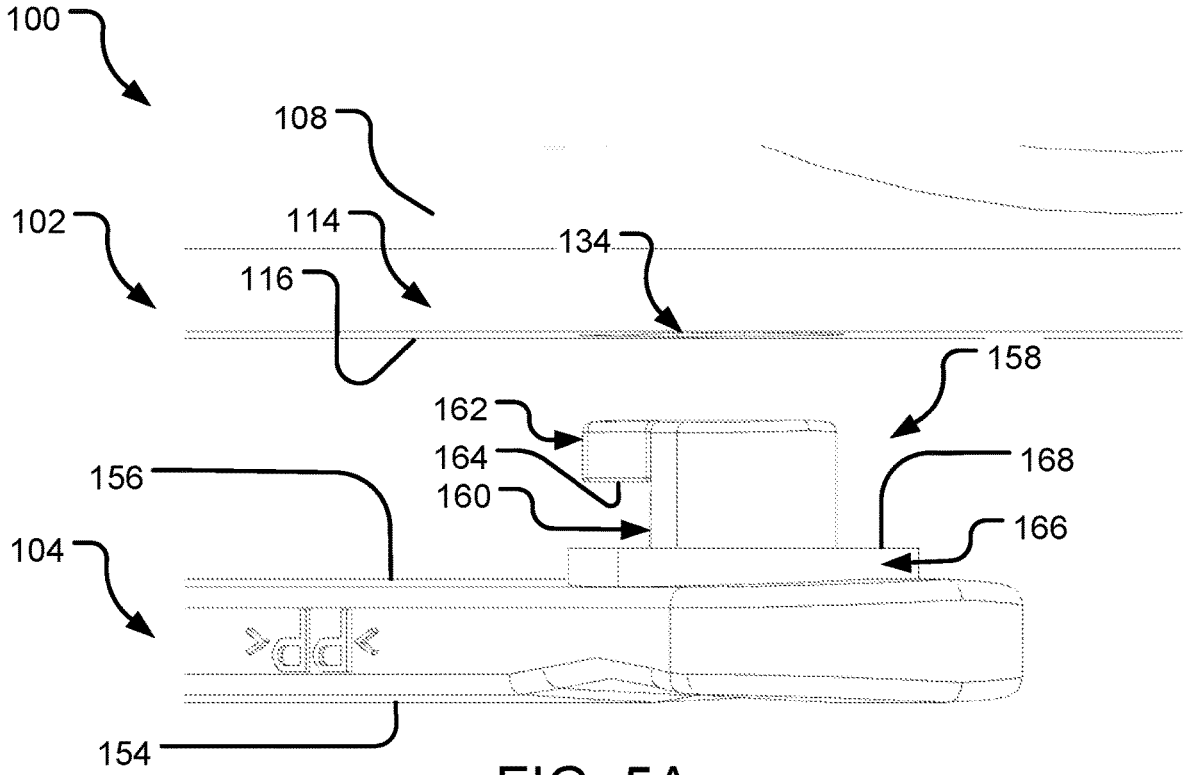
FIGS. 5A-5F illustrate one instance of a handle being removably coupled to a tray.
Figure 5B:
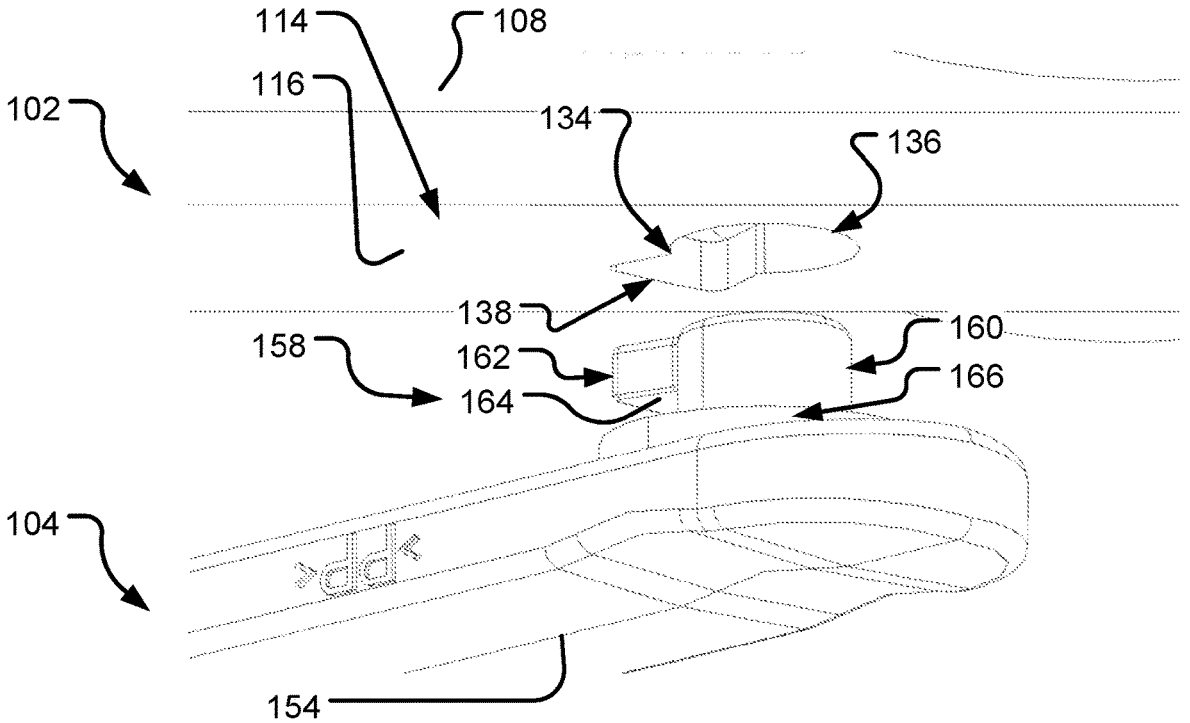
Figure 5C:
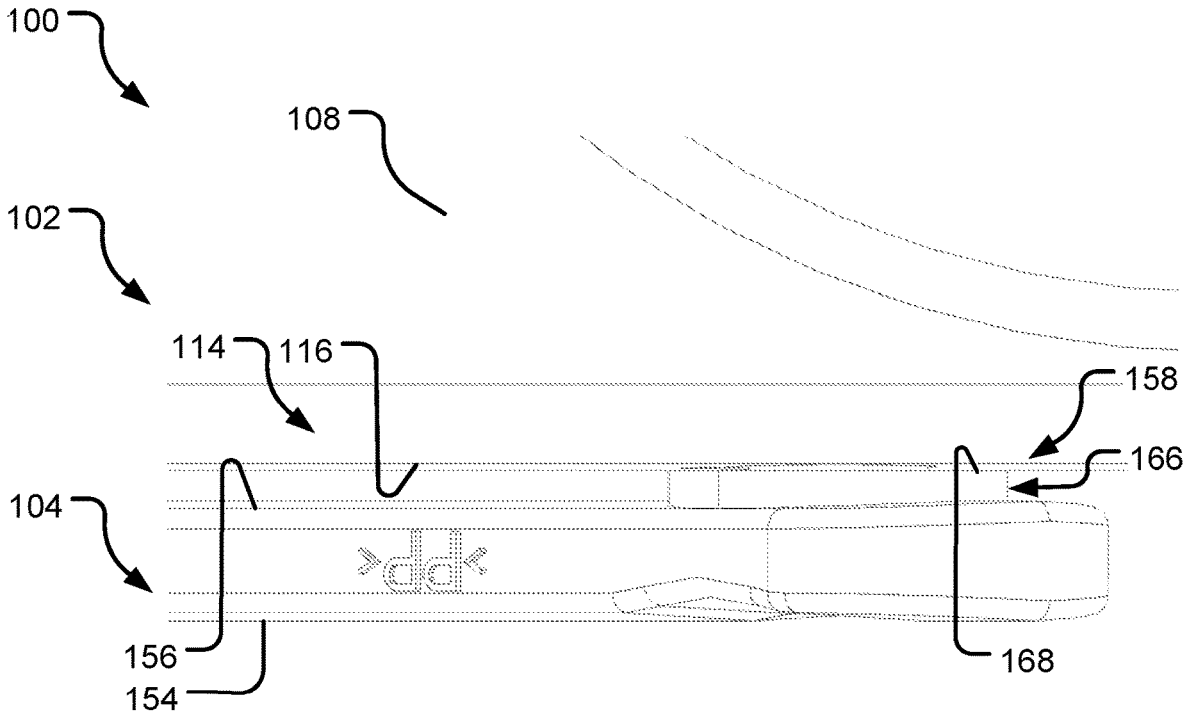
Figure 5D:
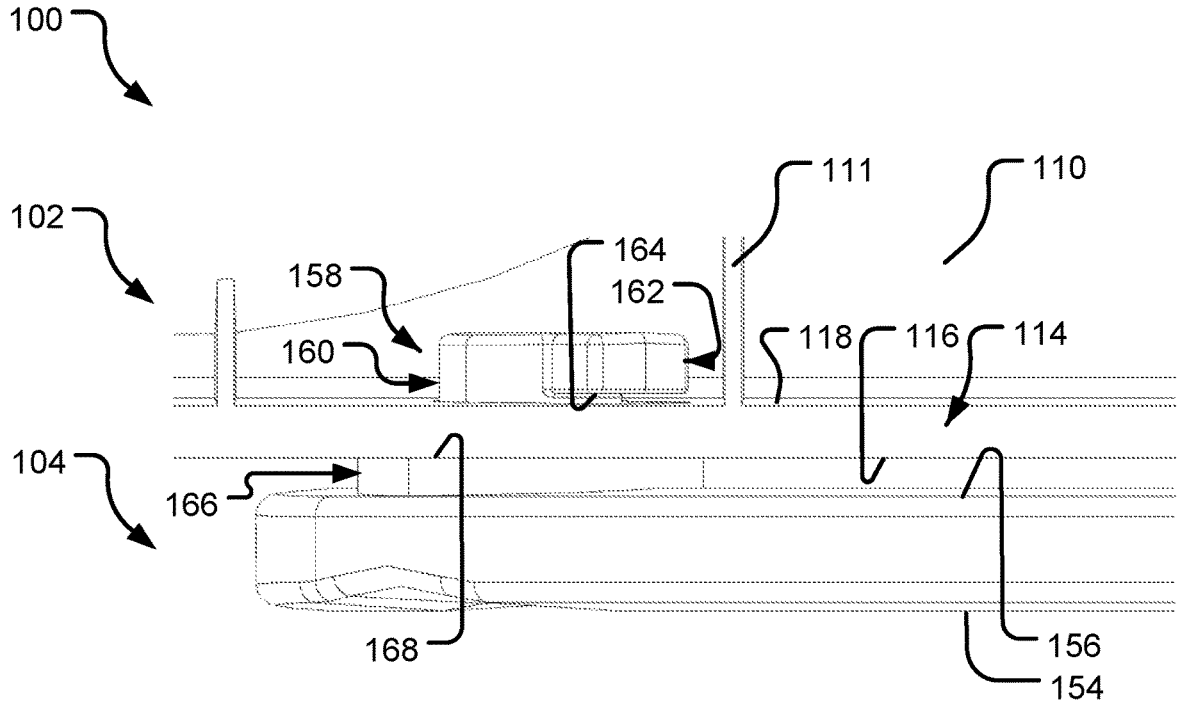

The key 162 and post 160 of the handle-mounting protrusion 158 can be advanced (e.g., inserted) through the borehole 136 and keyway 138 of the handle-mounting aperture 134, as illustrated, for example, in the top view in FIG. 5C and bottom view in FIG. 5D. The inner surface 168 of the spacer 166 of the handle 104 and/or the inner surface 156 of the elongated body 148 of the handle 104 can be in contact with (e.g., co-planar with) the outer surface 116 of the sidewall 114 of the tray 102.

Figure 5E:
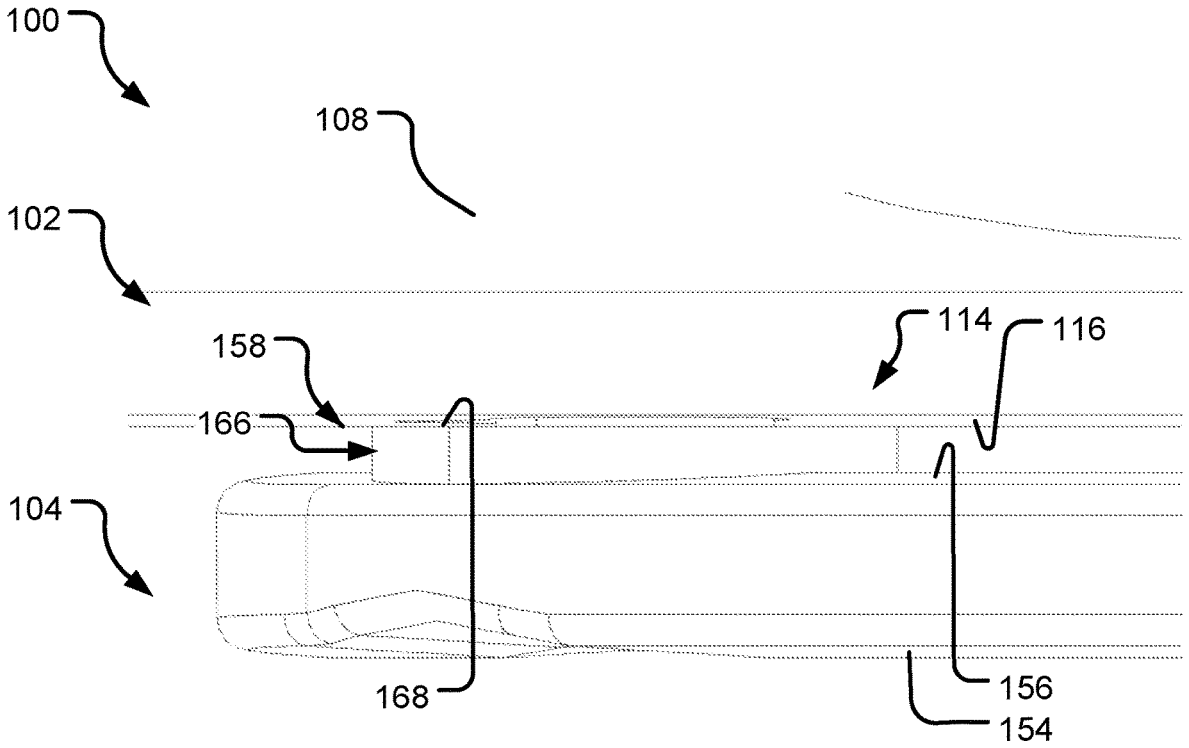
Figure 5F:
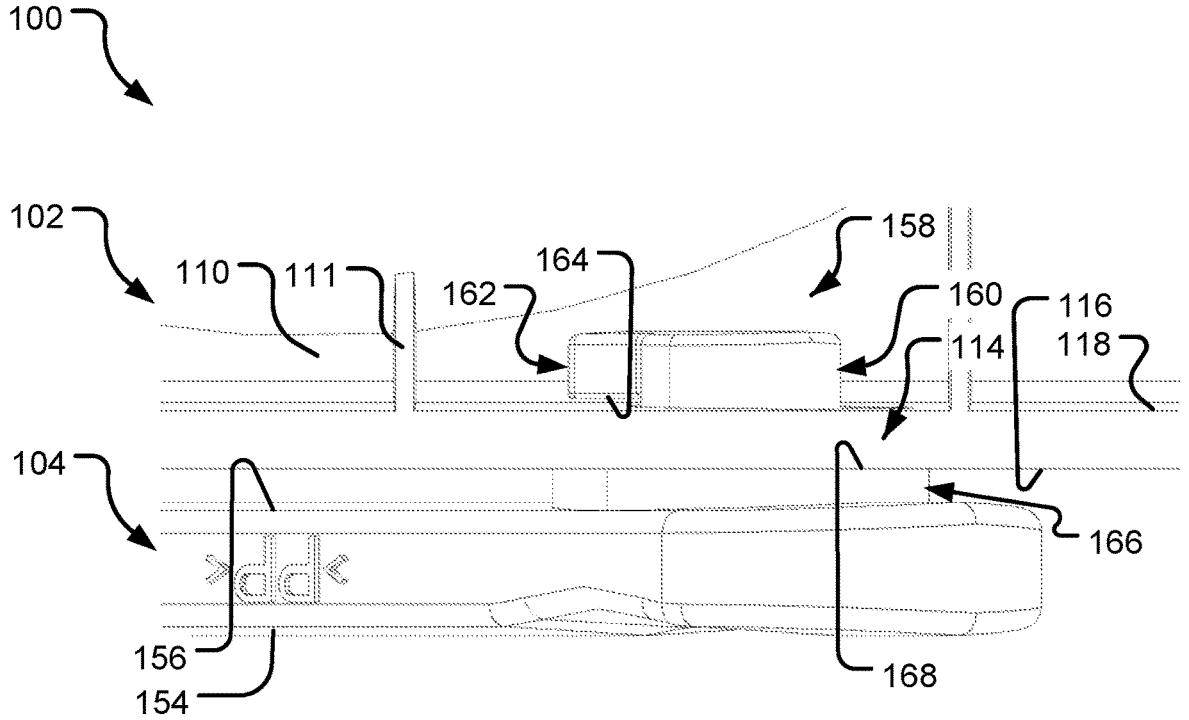

The handle-mounting protrusion 158 and handle-mounting aperture 134 can be rotatably engaged with respect to each other, so that the inner surface 164 of the key 162 is in contact (e.g., co-planar) with the inner surface 118 of the sidewall 114 of the tray 102, as illustrated, for example, in the top view in FIG. 5E and bottom view FIG. 5F. On the other hand, disengaging the handle 104 and the tray can include rotatably disengaging the key 162, so that the key 162 is aligned with the keyway 138 of the handle-mounting aperture 134, The key 162 and post 160 of the handle-mounting protrusion 158 can be backed out of (e.g., withdrawn) from the borehole 136 and keyway 138 of the handle-mounting aperture 134 to decouple (e.g., detach) the handle 104 from the tray 102.

Continuing with FIGS. 5A-5F, when the handle 104 is removably coupled to the tray 102, the surface of the post 160 (e.g., outer cylindrical surface) of the handle-mounting protrusion 158 can be in contact with the borehole 136 of the handle-mounting aperture 134 of the tray 102 (e.g., the diameter of the post 160 can be substantially the same as the diameter of the borehole 136).

Additionally, when the handle 104 and tray 102 are removably coupled together, the inner surface 168 of the spacer 166 of the handle 104 and/or the inner surface 156 of the elongated body 148 of the handle 104 can be in contact with the outer surface 116 of the sidewall 114 of the tray 102. In some instances, the planar inner surface 168 of the spacer 166 of the handle 104 and/or the inner surface 156 of the elongated body 148 of the handle 104 can be co-planar with the planar outer surface 116 of the sidewall 114 of the tray 102.

Additionally, when the handle 104 and tray 102 are removably coupled together, the inner surface 164 of the key 162 of the handle 104 is in contact (e.g., co-planar) with the inner surface 118 of the sidewall 114 of the tray 102. In some instances, the length of each post 160 (e.g., defined from the inner surface 168 of the spacer 166 of the and/or the inner surface 156 of the elongated body 148 to the inner surface 164 of the key 162) of the handle 104 can be substantially the same as the thickness of the sidewall 114 of the tray 102.

Continuing with FIGS. 5A-5F, one or more surfaces of the handle 104 can abut one or more surfaces of the tray 102 when the handle 104 and tray 102 are removably coupled together, as discussed in the preceding paragraphs. The post 160 of the handle 104 can abut the borehole 136 of the tray 102, the inner surface 168 of the spacer 166 and/or the inner surface 156 of the elongated body 148 of the handle 104 can abut the sidewall 114 of the tray 102, and/or the key 162 can abut the sidewall 114 of the tray 102.

When the handle 104 and tray 102 are engaged, the handle 104 can rotate about the longitudinal axis of the post 160 (e.g., the post 160 of the handle-mounting protrusion 158 of the handle 104 within the borehole 136 of the handle-mounting aperture 134 of the tray 102). The length of the elongated body 148 of the handle (e.g., as measured between the first end 150 and second end 152) can be configured so that each handle 104 can rotate around objects (e.g., cups) that are within the cup holders 140 of the tray 102 without interference.

Figure 6:
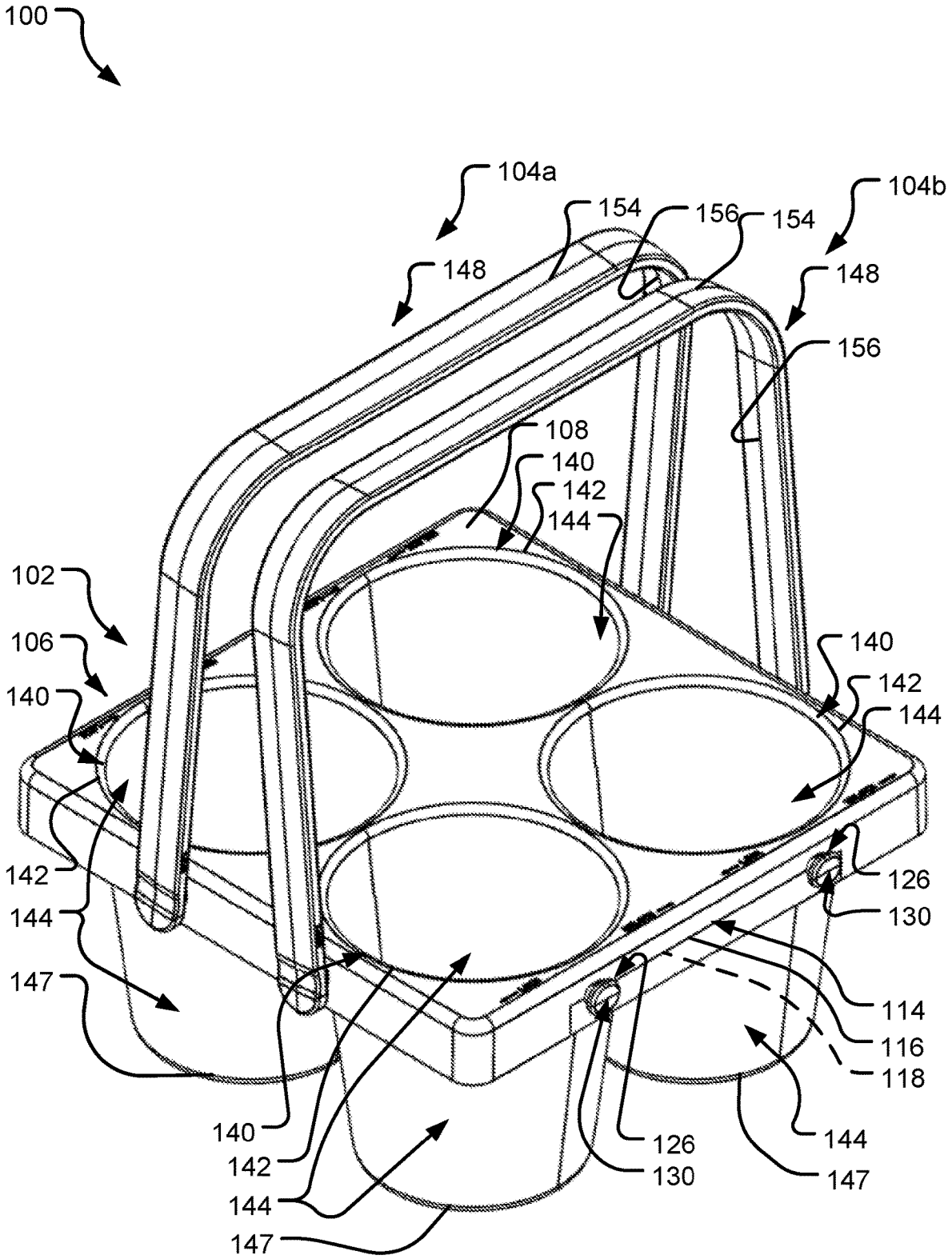
FIG. 6 illustrates a perspective view of one instance of a modular cup holder tray assembly.

FIG. 6 illustrates one instance of a modular cup holder assembly 100 that includes a first handle 104*a* and a second handle 104*b* removably coupled to a tray 102. In some instances, the cup holder assembly 100 includes one tray 102 (e.g., does not include more than one tray removably coupled together). The cup holder assembly 100 can receive and support one or more cups (not shown in FIG. 6), as previously discussed.

A modular cup holder assembly 100 kit can include any components described herein. In some cases, the kit can be in at least one container (e.g., packaging). In some instances, the kit can include one or more instruction guide. In some instances, the kit can include at least one tray 102 and at least handle. In some instances, the kit can include more than two trays 102 and more than four handles 104. In some instances, each tray 102 and each handle 104 within the kit can be uniform (e.g., standardized) so that they are interchangeable within cup holder assemblies 100.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. From the above description and drawings, it will be understood by those of ordinary skill in the art that the particular embodiments shown and described are for purposes of illustrations only and are not intended to limit the scope of the present invention. References to details of particular embodiments are not intended to limit the scope of the invention.

Reference an "embodiment", "aspect," "instance," or "example" means that a particular feature, structure, or characteristic described in connection with the embodiment is included in at least one embodiment of the disclosure. The appearances of the phrase in one "embodiment", "aspect," "instance," or "example" in various places in the specification are not necessarily all referring to the same embodiment, nor are separate or alternative embodiments mutually exclusive of other embodiments. Moreover, various features are described which may be exhibited by some embodiments and not by others.

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any example term. Likewise, the disclosure is not limited to various embodiments given in this specification.

What is claimed is:

1. A modular cup holder tray assembly comprising:

a first tray and a second tray removably coupled to each other, each of the first and second trays including:

a base defining a top surface and a plurality of cup-holders extending therethrough;

sidewalls substantially perpendicular to the base, the sidewalls including a first sidewall and a second sidewall opposite the first sidewall, the first sidewall defining a first outer planar surface and a first inner planar surface, at least two tray-coupling apertures extending through the first sidewall from the first outer planar surface to the first inner planar surface, the second sidewall defining a second outer planar surface and including at least two tray-coupling protrusions extending from the second sidewall; and a first handle removably coupled to the outer planar surface of the sidewalls of the first tray and a second handle removably coupled to the outer planar surface of the sidewalls of the second tray, wherein, when the first tray is removably coupled to the second tray, the at least two tray-coupling protrusions of the second tray are received through the at least two tray-coupling apertures of the first tray and the second outer planar surface of the second tray abuts the first outer planar surface of the first tray, wherein the first handle and the second handle are operable to transport the first tray and the second tray when the first handle is coupled to the first tray, the second handle is coupled to the second tray, and the first tray is coupled to the second tray.

2. The modular cup holder tray assembly of claim 1, wherein the first outer planar surface of the first tray abutting the second outer planar surface of the second tray inhibits rotation between the first tray and the second tray when the first tray and the second tray are removably coupled together and the first tray and the second tray are transported by the first handle and the second handle.

3. The modular cup holder tray assembly of claim 1, wherein the top surface of each of the first tray and the second tray is planar, wherein when the first tray is removably coupled to the second tray the top surface of the first tray and the top surface of the second tray are substantially co-planar, wherein the top surface of the first tray and the top surface of the second tray remain substantially co-planar when the first tray and the second tray are transported by the first handle and the second handle.

4. The modular cup holder tray assembly of claim 1, wherein the first outer planar surface of the first tray and the second outer planar surface of the second tray are substantially co-planar when the first tray is removably coupled to the second tray, wherein the first outer planar surface of the first tray and the second outer planar surface of the second tray remain substantially co-planar when the first tray and the second tray are transported by the first handle and the second handle.

5. The modular cup holder tray assembly of claim 1, wherein the top surface of the first tray and the top surface of the second tray each contain markings to indicate a lock direction to slidably engage the first tray and second tray, wherein the top surface of the first tray and the top surface of the second tray each contain markings to indicate an unlock direction to slidably disengage the first tray and second tray.

6. The modular cup holder tray assembly of claim 1, wherein the sidewalls further include a third sidewall and a fourth sidewall opposite the third sidewall, the third sidewall defining a third outer planar surface and a third inner planar surface, at least two handle-mounting apertures extending though the third sidewall and configured to removably couple to a first end of the first handle or the second handle, the fourth sidewall defining a fourth outer planar surface and a fourth inner planar surface, at least two handle-mounting apertures extending through the fourth sidewall and configured to removably couple to a second end of the first handle or the second handle.

7. The modular cup holder tray assembly of claim 6, wherein the at least two handle-mounting apertures each include a borehole and a keyway in communication with the borehole, wherein the borehole includes a substantially circular cross-section, wherein the keyway is oriented downward and inward from the borehole when the top surface is parallel with a horizontal plane.

8. The modular cup holder tray assembly of claim 7, wherein a midline of the keyway forms approximately a 45-degree angle with respect to the top surface, wherein the midline of the keyway forms approximately a 45-degree angle with respect to a vertical plane located between and parallel to the first sidewall and the second sidewall.

9. The modular cup holder tray assembly of claim 6, wherein the first and second handles each include a handle-mounting protrusion extending from each of a first end and a second end, the handle-mounting protrusions configured to engage and removably couple to one of the at least two handle-mounting apertures.

10. The modular cup holder tray assembly of claim 9, wherein the handle-mounting protrusion includes a post and a key, the post coupled to the first or second handle and extending outwards therefrom, the key coupled to the post and extending radially outward therefrom, wherein the post includes a circular cross-section and defines a diameter, wherein the at least two handle-mounting apertures each include a circular cross-section and define a diameter, wherein the diameter of the post is smaller than a diameter of the handle-mounting aperture, wherein the key is configured to contact an inner surface of the third sidewall or an inner surface of the fourth sidewall when the handle-mounting protrusion is inserted through the handle-mounting aperture and rotated to couple the first or second handle to the first or second tray.

11. The modular cup holder tray assembly of claim 10, wherein the handle-mounting protrusion includes a spacer between the first or second handle and the post, wherein the spacer includes a substantially circular cross-section that defines a diameter, wherein the diameter of the spacer is greater than the diameter of the post.

12. The modular cup holder tray assembly of claim 1, wherein the at least two tray-coupling apertures each include a receiving borehole and a retaining borehole in communication with the receiving borehole.

13. The modular cup holder tray assembly of claim 12, wherein the receiving borehole includes a substantially circular cross-section that defines a diameter and a center point, wherein the retaining borehole includes a substantially circular cross-section that defines a diameter and a center point, wherein the diameter of the retaining borehole is smaller than the diameter of the receiving borehole, wherein a line segment connecting the center point of the retaining borehole to the center point of the receiving borehole is horizontal when the top surface is parallel with a horizontal plane.

14. The modular cup holder tray assembly of claim 1, wherein the at least two tray-coupling protrusions each includes a post and a head, the post coupled to the second sidewall and extending outwards therefrom, the head coupled to the post, wherein the post includes a substantially circular cross-section that defines a diameter, wherein the head includes a substantially circular cross-section that defines a diameter, wherein the diameter of the head is greater than the diameter of the post.

15. The modular cup holder tray assembly of claim 14, wherein the post includes a rib extending radially outward therefrom, the rib coupled to the head and to the second sidewall.

16. A modular cup holder tray assembly comprising:

a first tray and a second tray removably coupled to each other, each of the first and second trays including:

a base defining a top surface and a plurality of cup-holders extending therethrough;

sidewalls substantially perpendicular to the base, the sidewalls including a first sidewall opposite a second sidewall and a third sidewall opposite a fourth sidewall, the first sidewall defining a first outer planar surface and a first inner planar surface, at least two tray-coupling apertures extending through the first sidewall from the first outer planar surface to the first inner planar surface, the second sidewall defining a second outer planar surface and including at least two tray-coupling protrusions extending from the second sidewall, the third sidewall defining a third outer planar surface and a third inner planar surface, at least two handle-mounting apertures extending though the third sidewall, the fourth sidewall defining a fourth outer planar surface and a fourth inner planar surface, at least two handle-mounting apertures extending through the fourth sidewall; and a first handle and a second handle, each of the first and second handles including a first end and a second end opposite the first end, the first end including a handle-mounting protrusion that is removably coupled to one of the at least two handle-mounting apertures extending through the third sidewall of the first or second tray, the second end including a handle-mounting protrusion that is removably coupled to one of the at least two handle-mounting apertures extending through the fourth sidewall of the first or second tray, wherein, when the first tray is removably coupled to the second tray, the at least two tray-coupling protrusions of the second tray are received through the at least two tray-coupling apertures of the first tray and the second outer planar surface of the second tray abuts the first outer planar surface of the first tray.

17. The modular cup holder tray assembly of claim 16, wherein the at least two handle-mounting apertures each include a borehole and a keyway in communication with the borehole, wherein the borehole includes a substantially circular cross-section, wherein the keyway is oriented downward and inward from the borehole when the top surface is parallel with a horizontal plane.

18. The modular cup holder tray assembly of claim 16, wherein the handle-mounting protrusions each include a post and a key, the post coupled to the first or second handle and extending outwards therefrom, the key coupled to the post and extending radially outward therefrom, wherein the post includes a circular cross-section and defines a diameter, wherein the at least two handle-mounting apertures each include a circular cross-section and define a diameter, wherein the diameter of the post is smaller than a diameter of the handle-mounting aperture, wherein the key is configured to contact the third inner planar surface of the third sidewall or the fourth inner planar surface of the fourth sidewall when the handle-mounting protrusion is inserted through the handle-mounting aperture and rotated to couple the first or second handle to the tray.

19. The modular cup holder tray assembly of claim 16, wherein the at least two tray-coupling apertures each include a receiving borehole and a retaining borehole in communication with the receiving borehole, wherein the receiving borehole includes a substantially circular cross-section that defines a diameter and a center point, wherein the retaining borehole includes a substantially circular cross-section that defines a diameter and a center point, wherein the diameter of the retaining borehole is smaller than the diameter of the receiving borehole, wherein a line segment connecting the center point of the retaining borehole to the center point of the receiving borehole is horizontal when the top surface is parallel with a horizontal plane.

20. The modular cup holder tray assembly of claim 16, wherein the at least two tray-coupling protrusions each includes a post and a head, the post coupled to the second sidewall and extending outwards therefrom, the head coupled to the post, wherein the post includes a substantially circular cross-section that defines a diameter, wherein the head includes a substantially circular cross-section that defines a diameter, wherein the diameter of the head is greater than the diameter of the post.

* * * * *